US006209503B1

(12) United States Patent
Komada et al.

(10) Patent No.: US 6,209,503 B1
(45) Date of Patent: Apr. 3, 2001

(54) INTAKE DUCT

(75) Inventors: Minoru Komada, Yokkaichi; Kazuo Fujihara, Komaki; Yoshikazu Hirose, Haguri-gun; Takahiro Komori, Inazawa; Hitoshi Kino, Ichinomiya; Hidetoshi Ishihara, Nagoya, all of (JP)

(73) Assignee: Toyoda Gosei Co., Ltd., Nishikasugai-gun (JP)

( * ) Notice: Subject to any disclaimer, the term of this patent is extended or adjusted under 35 U.S.C. 154(b) by 0 days.

(21) Appl. No.: 09/293,148

(22) Filed: Apr. 16, 1999

(30) Foreign Application Priority Data

| | | |
|---|---|---|
| Apr. 16, 1998 | (JP) | 10-106740 |
| Jun. 2, 1998 | (JP) | 10-153139 |
| Nov. 12, 1998 | (JP) | 10-321714 |
| Nov. 12, 1998 | (JP) | 10-321746 |
| Nov. 12, 1998 | (JP) | 10-321748 |
| Mar. 15, 1999 | (JP) | 11-068573 |

(51) Int. Cl.[7] ..... F02M 35/12; F01N 1/16
(52) U.S. Cl. ..... 123/184.56
(58) Field of Search ..... 123/184.56, 184.53

(56) References Cited

U.S. PATENT DOCUMENTS

| | | | | |
|---|---|---|---|---|
| 4,274,368 | * | 6/1981 | Shaffer | 123/184.56 |
| 4,858,567 | * | 8/1989 | Knapp | 123/184.56 |
| 4,862,840 | * | 9/1989 | Matsunaga et al. | 123/184.56 |
| 4,911,111 | * | 3/1990 | Matsunaga | 123/184.56 |

FOREIGN PATENT DOCUMENTS

| | | | | |
|---|---|---|---|---|
| 3743056 | * | 7/1988 | (DE) | 123/184.56 |

* cited by examiner

*Primary Examiner*—Marguerite McMahon
(74) *Attorney, Agent, or Firm*—Pillsbury Madison & Sutro LLP

(57) ABSTRACT

An intake duct capable of reducing intake noise when an engine runs at a low speed and supplying a sufficiently large amount of air when the engine runs at a high speed without using any electron control circuit or electromagnetic valve, which is produced at low costs. The intake duct includes valve adjusting means which restrains the movement of the valve member when the valve member brings a second intake passage from the closed state to the open state, and facilitates the movement of the valve member when the valve member brings the second intake passage from the open state to the closed state. When the second intake passage is brought to the open state from the closed state, the restraining force of the valve adjusting means is great to restrain the movement of the valve member, and when the second intake passage is brought to the closed state from the open state, the valve member readily pivots to open the second intake passage. Thus, the valve member is free from the half-closed state, and consequently, the generation of low-frequency booming noise can be prevented.

13 Claims, 27 Drawing Sheets

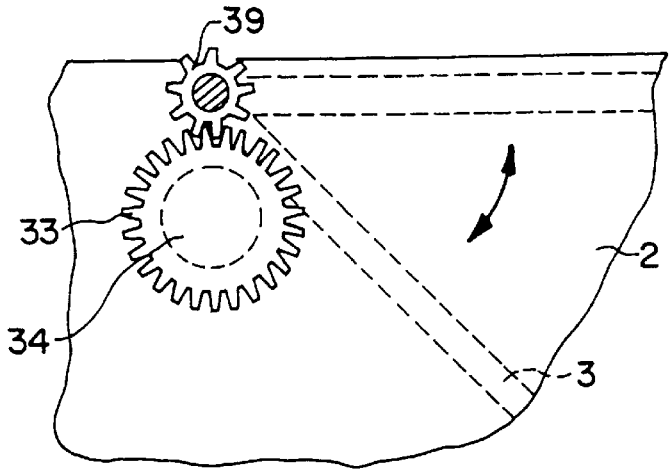
FIG. 15
FIG. 16
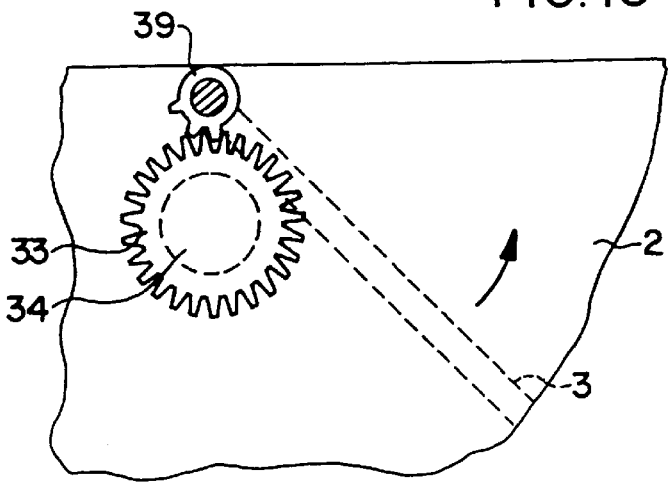
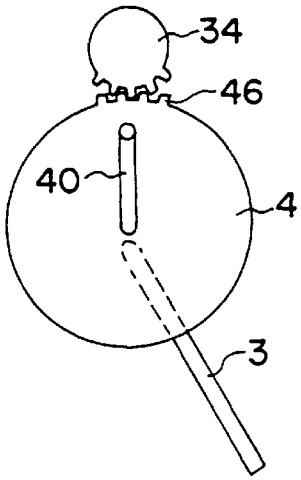
FIG. 17

INTAKE DUCT

BACKGROUND OF THE INVENTION

1. Field of the Invention

The present invention relates to an intake duct as a passageway adapted to supply air to an engine, and more particularly to an intake duct capable of reducing noise during use.

2. Description of the Related Art

Intake systems used with motor vehicle engines generate noise in conjunction with the intake of air. This intake noise is offensive to persons in the motor vehicle, particularly when the engine is running at low speeds. Conventionally, side branches and/or resonators have been provided in such intake ducts to reduce the noise at a specific frequency, calculated, for instance, in accordance with the Helmholtz's resonance theory.

However, the side branches may be as long as about 30 cm, and the resonators may have a volume as great as 14 litters. To install these devices in the engine compartment, increased space is needed which necessarily decreases the amount of room available for installing other parts.

Japanese Utility Model application laid-open No. Sho 64-22866 discloses an arrangement where orifices are provided in an intake duct, and intake air is throttled at the positions of the orifices; thereby reducing intake noise. By throttling the intake passage in this manner, the acoustic mass increases, and consequently, the intake noise of the engine at low frequencies can be reduced.

Japanese Utility Model application laid-open No. Hei 3-43576 discloses a device for reducing intake noise that includes two intake pipes, and a valve which selectively opens and closes the upstream side of one of the intake pipes in accordance with the an operating mode of the engine.

An intake duct shown in FIG. 49 for example, corresponds to the intake duct disclosed in Japanese Utility Model application laid-open No. Hei 3-43576, and includes a first intake pipe 1000 of a small diameter and a second intake pipe 2000 of a larger diameter. In the second intake pipe 2000, a valve 3000 is pivotably provided. A pivot shaft of the valve 3000 is connected to a center of a disk-like cam 4000, and a spring 5000, one end being fixed to a vehicle body, is secured to a periphery of the cam 4000. The spring 5000 is arranged such that the biasing force thereof is reduced to a minimum when valve 3000 fully closes the second intake pipe 2000.

With the intake duct thus arranged and the intake pressure of the second intake pipe 2000 less than a predetermined value, valve 3000 fully closes the second intake pipe 2000 so that air is drawn through only the first intake pipe 1000; this reduces intake noise across low frequencies. When the intake pressure exceeds the predetermined value, valve 3000 pivots against the biasing force of spring 5000, which is transmitted through cam 4000, to increase the opening area of the second intake pipe 2000 in proportion to the intake pressure, thus enabling a sufficient amount of air to be supplied.

The above-described method of throttling the intake passage, however, produces a problem when the engine runs at a high--speed since the amount of intake air is insufficient and lowers the engine output.

With the device disclosed in Japanese Utility Model application laid-open No. Hei 3-43576, there is a state where valve 3000 is held between a fully closed position and its fully-open position to prolong the time period the second intake pipe 2000 is half closed. In this case, the problem is that since the acoustic mass is small, the intake noise is large even though the engine is running at a low speed, resulting in booming noise of low frequencies entering the passenger compartment of the motor vehicle.

Furthermore, Japanese Utility Model application laid-open No. Hei 3-43576 discloses the use of an electronic control circuit, an electromagnetic valve, and a diaphragm actuator, or the like, for operating a valve member. The use of these parts increases in the total number of parts used, and also increases the complexity of the device, both of which are less favorable in terms of production costs.

SUMMARY OF THE INVENTION

It is an object of the present invention to provide an intake duct capable of: 1) reducing intake noise when an engine runs at low speeds; 2) introducing a sufficient amount of air when the engine runs at a high speed; 3) preventing the generation of low frequency booming noise; and 4) being produced at low costs without using any electronic control circuit, electromagnetic valve or the like.

In a first aspect of the present invention, the intake duct, as a passageway adapted to supply air to an engine, includes a first intake passage, a second intake passage, a valve member pivotably provided in the second intake passage for opening and closing the second intake passage, and a biasing device for biasing the valve member towards a closed position in the second intake passage. The valve member has been designed to have limited movement when it opens the second intake passage and yet exhibit easy movement when it closes the second intake passage.

As noted above, the intake duct made in accordance with the present invention has first and second intake passages, and a valve member which opens and closes the second intake passage. When the engine runs at a low speed, intake pressure in the second intake passage is equal to or less than a predetermined value. So, by determining the biasing force of the biasing device to be greater than such a predetermined value, when the engine runs at a low speed the valve member closes the second intake passage and only the first intake passage remains open. Accordingly, when the engine runs at a low speed, the resultant intake passage is in a throttled state thus increasing the acoustic mass, and thereby reducing low frequency intake noise.

When the engine runs at a high speed, the intake pressure in the second intake passage exceeds the biasing force so that the valve member opens the second intake passage. This resultant intake passage is enlarged, and consequently, a sufficient amount of air can be supplied to the engine running at a high speed. Intake noise is generated at this time, but in comparison to the engine noise it is so small so as to not be perceived.

The intake duct of the present invention further includes valve adjusting mechanism adapted to limit the movement of the valve member when the valve member opens the second intake passage and to facilitate movement of the valve member when the valve member closes the second intake passage.

The movement of the valve member is limited or facilitated by the valve adjusting mechanism. When the intake pressure is at a predetermined value or less and the valve member closes the second intake passage, the valve member is held in its fully closed position by the biasing force exerted by the biasing device and as limited by the valve adjusting mechanism. When the engine runs at a high speed, the intake pressure is greater than the predetermined value and when it overcomes the biasing force the valve member will be held in its opening state within the second intake passage. At this time, the limiting force of the valve adjusting mechanism for limiting the movement of the valve member is small so that when the intake pressure decreases the valve member readily moves with the biasing force in such a direction so as to close the second intake passage. Once the valve member closes the second intake passage, the limiting force is exerted by the valve adjusting mechanism. This results in a time period in which the valve member opens half of the second intake passage to decrease, thus preventing booming noises from being perceived.

To improve these operational advantages further, it is preferable to decrease the opening area of the first intake passage and to increase the opening area of the second intake passage. Where the intake duct has a branch arrangement wherein two intake passages, including first and second intake passage, respectively, are joined to define a single intake passage, it is preferable to make the first intake passage thinner to increase the acoustic mass further while making the second intake passage thicker to enable a sufficient amount of air to be supplied.

Examples of the valve member include a valve which opens and closes the second intake passage with a pivotal movement thereof. Examples of the biasing device include those which use gravity, as well as those using biasing with a spring force. These biasing devices can be arbitrarily selected. Furthermore, side branches and resonators may be provided. With the intake duct made in accordance with the present invention, intake noise of low frequencies can be reduced without providing any side branch structure or resonator. Accordingly, to improve the freedom of installing other parts by reducing the space for the intake duct in the engine compartment, it is desirable not to provide such side branches and resonators therein.

The predetermined value of intake pressure $F_1$ in the second intake passage, when the valve member closes the second intake passage, and the predetermined value of intake pressure $F_2$ in the second intake passage, when the valve member opens the second intake passage, have a relationship of $F_1 \leqq F_2$. When the difference between $F_1$ and $F_2$ is too small, the valve member flutters at the time the valve member opens the second intake passage, thus frequently causing noise. When the difference between $F_1$ and $F_2$ is too large, the amount of intake air is frequently short. Accordingly, the predetermined values $F_1$ and $F_2$, the biasing force of the biasing device or the like, must be determined carefully.

It is preferable that the valve adjusting mechanism limit the movement of the valve member strongly at the beginning of movement from the closed position toward the open position, and weakly in the middle and end of the movement cycle from the closed to open position. With this arrangement, at the beginning of the movement, the valve member moves slowly, and when the intake pressure increases further, the valve member then moves rapidly to fully open the second intake passage. This results in suppressing the fluttering of the valve member and preventing the leakage of intake noise through the gap between the second intake passage end valve member.

When the intake pressure of the second intake passage decreases to a predetermined value or less, and consequently, the valve member is closed, the valve member moves with the biasing force of the biasing device. At this time, the valve adjusting mechanism acts to facilitate the movement of the valve member so that the valve member closes the second intake passage quickly and surely to prevent the leakage of intake noise through the gap between the second intake passage and valve member.

The valve adjusting mechanism limits movement of the valve member when the valve member opens the second intake passage, and facilitates movement of the valve member when it opens the second intake passage. The valve adjusting mechanism can use the difference in moment, mechanical engagement, attracting power with magnets, biasing force with springs or the like.

One example of a valve adjusting mechanism is a cam interposed between the valve member and the biasing device, having a center of pivotal movement to which a pivot shaft of the valve member is secured, and a point of action, provided away from the center of pivotal movement and on which the biasing force of the biasing means acts. When the intake pressure of the second intake passage is at the predetermined value or less, the rotational moment caused by the biasing force of the biasing device is greater than that caused by the intake pressure at the point of action, and consequently, the valve member closes the second intake passage. When the intake pressure of the second intake passage exceeds the predetermined value, the rotational moment caused by the intake pressure is greater than that caused by the biasing force at the point of action, and consequently, the valve member opens the second intake passage.

With the intake duct provided with the valve adjusting mechanism arranged for an engine running at a low speed, the intake pressure in the second intake passage is at the predetermined value or less so that the rotational moment caused by the biasing force becomes greater than that caused by the intake pressure at the point of action of the cam. Consequently, the second intake passage is closed by the valve member, and only the first intake passage remains open. This results in the collective intake passage being throttled to increase the acoustic mass therein, thus reducing the low frequency intake noise.

As the engine starts to run at a high speed, the intake pressure of the second intake passage will exceed the predetermined value, and consequently, the rotational moment caused by the intake pressure becomes greater than that caused by the biasing force at the point of action of the cam. Consequently, the valve member opens the second intake passage by the pivotal movement of the cam. This results in the intake passage being enlarged, thus enabling a sufficient amount of air to be supplied to the engine running at a high speed. In this case, intake noise is generated, but in comparison to the engine noise it is so small so as not to be perceived.

When the valve member closes the second intake passage, the force exerted on the valve member by the biasing device is great, so that the valve member readily pivots to its fully closed position. When the valve member opens the second intake passage, the force exerted on the valve member by the biasing means is small so that the valve member readily pivots to the fully open position with the intake pressure. This shortens the time period during which the valve member half opens the second intake passage, thus preventing booming noise from low frequencies to be perceived.

The valve adjusting mechanism may include a holder for holding the valve member in the closed state within the second intake passage, and control means for changing the holding of the valve member with the holder and the releasing of the valve member from the holder such that when the intake pressure in the second intake passage is at the predetermined value or less, the control means holds the valve member closed and when the intake pressure in the second intake passage exceeds the predetermined value, the control means releases the valve member holder, thus opening the second intake passage with the intake pressure.

With the intake duct provided with the valve adjusting mechanism so arranged, in the case where an engine runs at a low speed, the intake pressure in the second intake passage is at the predetermined value or less so that the control means holds the valve member closed, thus opening only the first intake passage. This results in throttling the intake passage to increase the acoustic mass therein, thus reducing the low frequency intake noise.

When the engine runs at a high speed and the intake pressure of the second intake passage exceeds the predetermined value, the control means to release the valve member holder so that the valve member opens the second intake passage. This results in an enlarged intake passage being ensured, thus enabling a sufficient amount of air to be supplied to the engine.

The holder can hold the valve member closed using mechanical engagement, attracting power with magnets, or a biasing force created by one or more springs or the like.

The control means can control the holder to hold and release the valve member, by using, for example, mechanical mechanisms such as a cam mechanism, various link mechanisms, or electrical switch mechanisms.

When the intake pressure increases and the valve member pivots, the valve member pivots slowly as the engine speed increases, end then pivots rapidly into the fully open state. So, at the beginning of the pivotal movement of the valve member, the valve member is slightly open for a short period of time. This causes the problem that intake noise leaks through the gap between the valve member and second intake passage.

To overcome this problem, it is desirable that the second intake passage is provided with a guide face adapted to guide an end face of the valve member which moves pivotally to open the second intake passage, and close to the end face of the valve member. With this arrangement, even when the valve member first pivots slowly as engine speed increases, the end face of the valve member moves close to the guide face of the second intake passage, thus preventing the generation of a gap between the valve member and second intake passage, and consequently, preventing the leakage of intake noise there through.

The above-described intake duct has the further problem that, at the time the valve member slightly opens the second intake passage, vibrations are generated in the valve member, causing the gerieration of noise. This is caused by intake air rapidly passing the space between the valve member and second intake passage which has a small cross-sectional area, and by the valve member being held in such a state for an extended time when the difference between the biasing force of the biasing device and the intake pressure is small, thereby readily transmitting the intake pulsations of the engine to the valve member.

To overcome this problem, it is desirable that the second intake passage be provided with an engaging face adapted to abut the valve member when the valve member closes the second intake passage, and further with resistance means adapted to exert a resistance force on the valve member when the valve member leaves the engaging face. With this arrangement, when the intake pressure increases such that the differential pressure between the biasing force and the intake pressure increases, and the valve member is about to pivot in such a direction as to open the second intake passage, the resistance force is exerted on the valve member by the resistance means to hold the valve member closed until the differential pressure force exceeds the resistance force exerted by the resistance means. When the differential pressure force exceeds the resistance force of the resistance means, the valve member rapidly pivots to open the second intake passage.

Consequently, with the intake duct thus arranged, the time period that the space of a small cross-sectional area is formed between the valve member and second intake passage can be extremely shortened. This prevents the generation of noise due to the vibrations of the valve member.

As the resistance means can comprise a material that will attract the valve member, such as a permanent magnet or an electromagnet, or a biasing member such as a spring, a damper or the weight of the valve member itself can be used.

As described above, with the intake duct in accordance with the present invention, when an engine runs at a low speed, low frequency intake noise can be reduced, and when the engine runs at a high speed, a sufficiently large amount of air can be supplied. In addition, extra members such as an electronic control circuit, electromagnetic valve or diaphragm actuator are not necessary so that the intake duct can be produced at low costs.

Other objects, features, end characteristics of the present invention will become apparent upon consideration of the following description and the appended claims with reference to the accompanying drawings, all of which form a part of the specification.

BRIEF DESCRIPTION OF THE DRAWINGS

FIG. 15 is a front view of a main part of a ninth embodiment of an intake duct in accordance with the present invention;

FIG. 16 is a front view of a main part of a tenth embodiment of an intake duct in accordance with the present invention;

FIG. 17 is a front view of a main part of a modification of the tenth embodiment of the present invention;

DETAILED DESCRIPTION OF THE PRESENTLY PREFERRED EXEMPLARY EMBODIMENTS

The present invention will be explained based on several embodiments.

(Embodiment 1)

Figure 1:
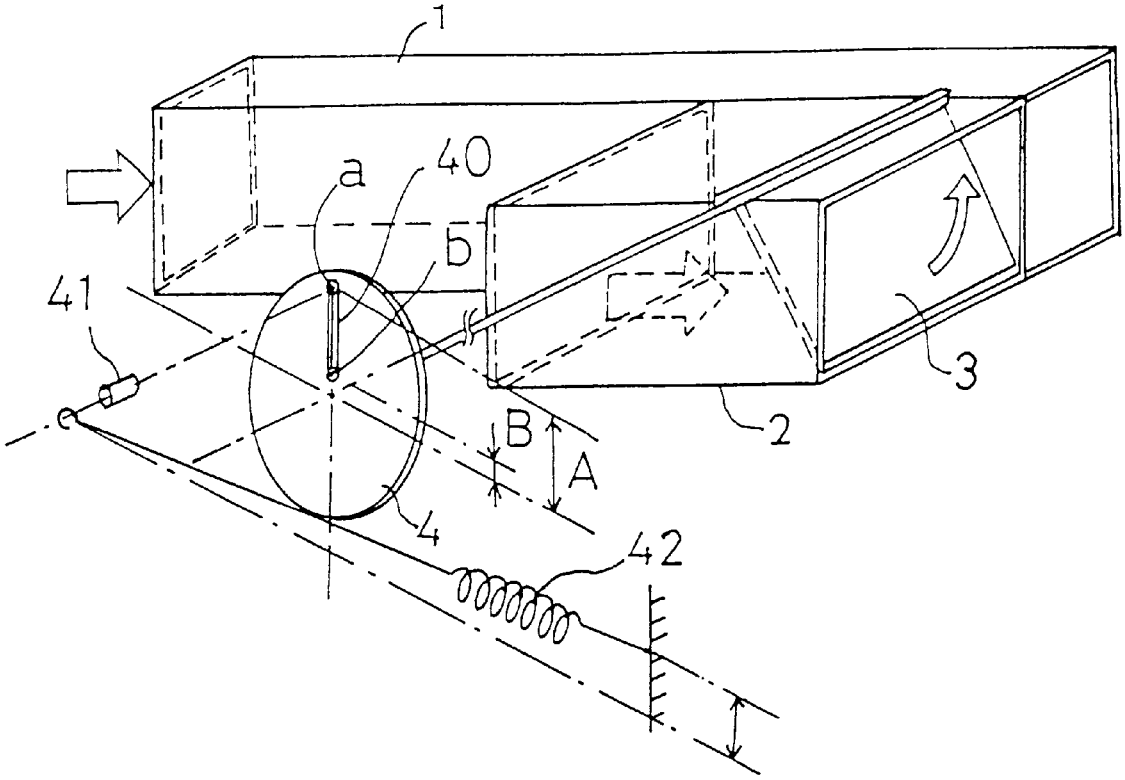
FIG. 1 is a diagram illustrating the arrangement of a first embodiment of an intake duct in accordance with the present invention.

FIG. 1 is a diagram explaining an intake duct of one exemplary embodiment. As shown, a first intake passage 1, with a small diameter, and a second intake passage 2 with a diameter greater than that of the first intake passage 1 are joined to define the collective intake duct. In FIG. 1, the junction of the first intake passage 1 and second intake passage 2 is not illustrated.

The cross-sectional area of the first intake passage 1 is equal to that of a pipe of Ø40, and the cross-sectional area of the second intake passage 2 is equal to that of a pipe of Ø70. The distance between an open end of the first intake passage 1 and the junction between the two intake passages is made longer than that between an open end of the second intake passage 2 and the same junction. A valve member 3 is pivotably mounted on a wall defining part of the second intake passage 2.

Figure 2:
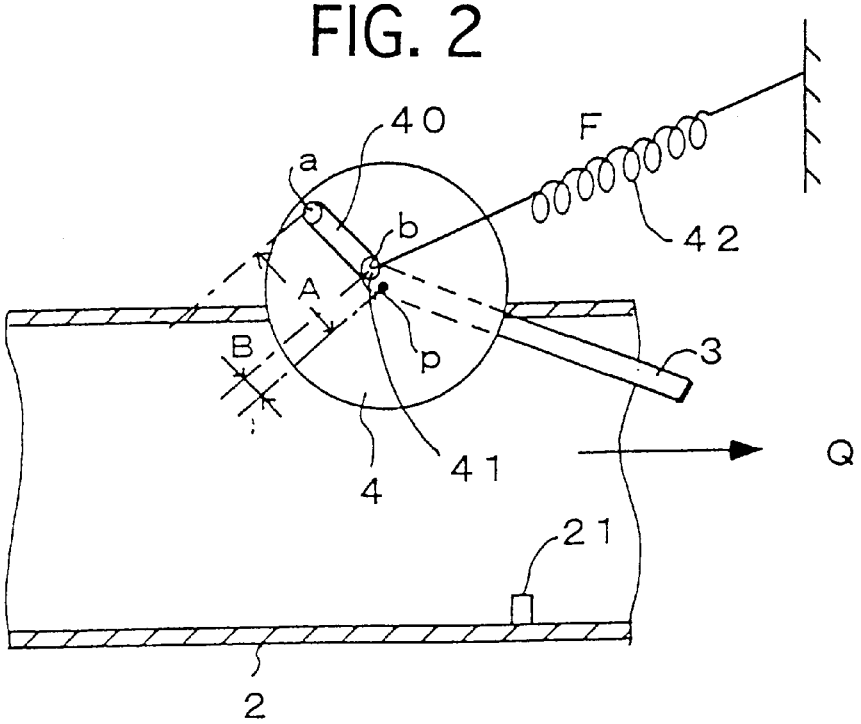
FIG. 2 is a diagram illustrating the operation of the first embodiment of the present invention at the time a valve is in the full-open position.

A cam 4, having a disk-like configuration, is connected at its center to a pivot shaft of the valve 3 such that valve 3 pivots in response to the turning of cam 4. Cam 4 has a slot 40 which extends radially out from the center thereof. A slide pin 41 shown in FIGS. 1 and 2, is engaged in the slot 40 and slides from one end (a) to the other end (b). In the present embodiment, the slide pin 41 defines a point of action. One end of a spring 42 is attached to the slide pin 41 while the other end thereof is secured to a vehicle body. The spring 42 biases the slide pin 41 so as to draw the same.

The securing end of the spring 42 is located in the offset position higher than the point (a) of the slot 40, which is a of the radially outermost end thereof. This results in the slide pin 41 being biased continuously so as to move to toward point (a) within the slot 40, and consequently, cam 4 being biased continuously pivots valve 3 so as to close the second intake passage 2.

FIG. 2 explains the state when the intake pressure Q, shown by the arrow, in the second intake passage 2 of the intake duct thus arranged is great causing valve 3 to fully open the second intake passage 2. In FIG. 2 slide pin 41 is located at point (b) of the slot 40, which is closest to the center point (F) of the cam 4. The rotational moment exerted by spring 42 to rotate cam 4 can be expressed simply by FB, omitting the trigonometric function, wherein the distance between the point (b) and the point of center (P) is B. The spring force of spring 42 is F. So, if the relation Q>FB exists, the present state is held, and consequently, the second intake passage 2 is held fully open.

When the valve 3 fully opens the second intake passage 2, intake air is supplied mainly via the second intake passage 2 since it has a greater diameter and shorter length than the first intake passage, so as to overcome the disadvantages of the first intake passage, such as the decrease in amount of intake air. Also, resultant intake noise is mixed with engine noise so that the intake noise is not perceived, and no unpleasant noise is generated.

When the intake negative pressure Q decreases and the relation Q<FB exists, cam 4 begins to turn in such a direction so as to close the second intake passage 2 under the biasing force of the spring 42. Since the slide pin 41 is biased continuously so as to move towards point (a), the valve 3 pivots with the movement of the slide pin 41 in the slot 40 to gradually close the second intake passage 2. Consequently, the distance between the slide pin 41 and the center point (P) gradually increases, which results in the rotational moment caused by the spring 42 to gradually increase and enlarge the difference between the intake pressure Q and rotational moment further. Thus, valve 3 pivots to close the second intake passage 2 with an increasing speed due to an increasing force.

Figure 3:
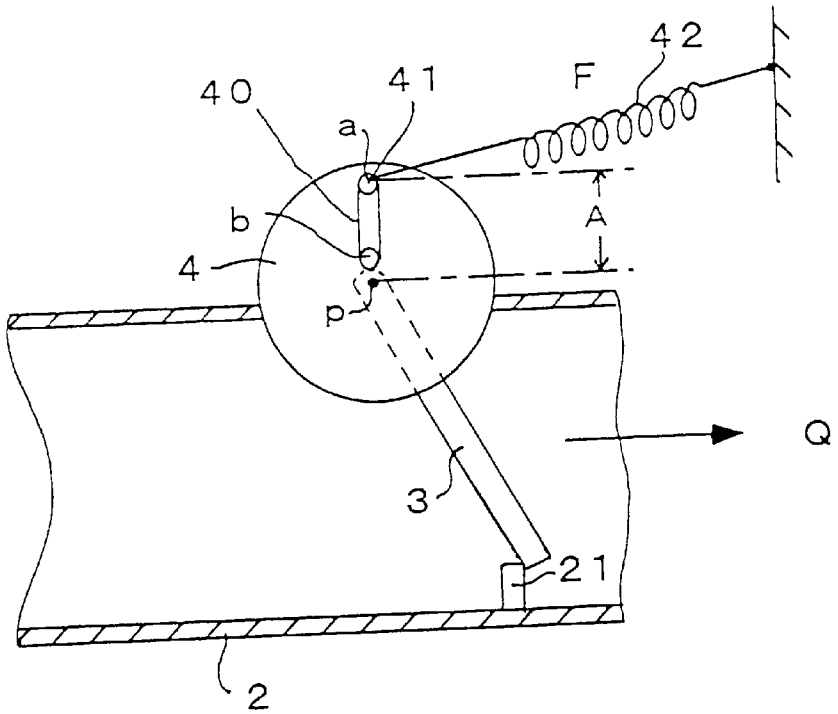
FIG. 3 is a diagram illustrating the operation of the first embodiment of the present invention at the time the valve is in the full-closed position.

When valve 3 abuts a projection 21 provided in the second intake passage 2, which defines the to fully closed position with the second intake passage 2, further pivotal movement of the valve 3 is prevented, and, at this time, as illustrated in FIG. 3, the slide pin 41 is located at point (a). In this state, the rotational moment for turning the cam 4 with the spring 42 is expressed simply by FA, wherein the distance between point (a) and the center point (P) is A as shown. Since there exists the relation of B<A, the relation of FB<FA is obtained so that provided the relation of Q<FB exists, this state is held. Thus, valve 3 is held fully closed in the second intake passage 2.

In the situation shown in FIG. 3, air is supplied only via the first intake passage 1 and since it has a smaller diameter a smaller cross-sectional area then the second intake passage 2, the acoustic mass increases reducing the low frequency intake noise without using any resonator or the like.

When the intake pressure Q increases to have the relation of FB<Q<FA exist, the slide pin 41 is biased toward point (a) with the force "F", because the spring 42 is in the offset position. Consequently, valve 3 is held fully closed. When the intake pressure Q increases further to create the relation FA+f<Q, valve 3 begins to pivot, and slide pin 41 moves in the slot 40, whereby the cam 4 turns. As the slide pin 41 moves, the rotational moment caused by spring 42 gradually decreases, and the difference between the intake pressure Q and rotational moment decreases further, resulting in valve 3 pivoting with an increasing speed to bring the second intake passages to the fully opened state. And then, that state is held until the relation of Q<FB becomes valid.

With the intake duct of the present embodiment, valve 3 can be held in the fully open state and fully closed state automatically in accordance with the intake pressure. Consequently, the reduction of the intake noise and insurance of a required amount of intake air can be effected without using any resonator or the like. Furthermore, the valve 3 pivots with an increased speed from a half opened or half closed state to its fully opened or fully closed state. Therefore, there is hardly a time when a gap exists between the second intake passage 2 and valve 3, so that disadvantages such as the generation of booming noise of low frequencies are prevented. Also, the intake duct of the present embodiment has a simple construction which does not require any electronic control system or diaphragm actuator. Consequently, the reliability thereof is enhanced and production costs are low.

(Embodiment 2)

Figure 4:
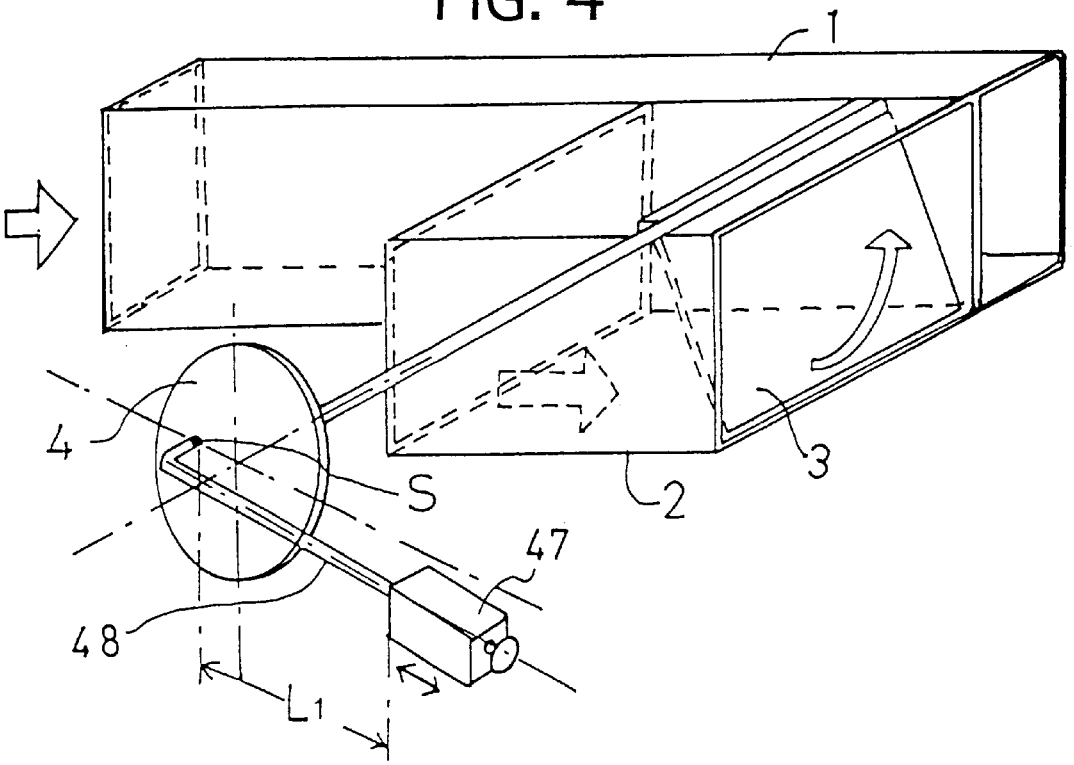
FIG. 4 is a diagram illustrating the arrangement of a second embodiment of an intake duct in accordance with the present invention.

FIG. 4 illustrates a second embodiment of an intake duct in accordance with the present invention. The intake duct of the present embodiment differs from that of Embodiment 1 in that spring 42 used in Embodiment 1 is replaced with a weight 47 having a weight equal to W.

More specifically, the pivot shaft of valve 3 is still connected to the center of a cam 4 as in, Embodiment 1. One end of a rod 48 is secured to cam 4 at a fixed point (S) offset from the center (P) thereof, and weight 47 is attached to rod 48 so as to be movable thereon. In the present embodiment, the fixed offset point (S) defines a point of action.

The intake duct of the present embodiment has the arrangement that, when valve 3 fully closes the second intake passage 2, the end of rod 48 is located slightly downwardly from its horizontal position, as illustrated in FIG. 4, and the weight 47 is retained of the end of rod 48 such so that the distance "L" between weight 47 and fixed point (S) becomes the maximum distance $L_1$. Thus, when the intake pressure Q is less than the rotational moment $WL_1$, which acts by the weight 47 on the cam 4 ($Q<WL_1$), the fully closed state of the value within second intake passage 2 is held.

When the intake pressure increases such that $WL_1$ and Q have the relation of $WL_1<Q$. valve 3 pivots and cam 4 starts to turn. This results in the end of rod 48, at which the weight 47 is located, to gradually move upwardly. When the position of the weight 47 becomes higher than that of the fixed point (S), weight 47 moves on rod 48 toward the fixed point (S) so that the distance L between weight 47 and fixed point (S) becomes shorter to gradually reduce the rotational moment $WL_1$. This increases the difference between the rotational moment $WL_1$ and intake pressure Q gradually and results in valve 3 pivoting with an increasing speed to fully open the second intake passage 2.

When the intake pressure Q decreases to have the relation of $Q<WL_2$, wherein the distance between weight 47 and fixed point (S) in the fully opening state of the valve 3 is $L_2$ (not illustrated), cam 4 starts to turn, and valve 3 gradually closes the second intake passage 2. When the horizontal position of weight 47 descends downward of the fixed point (S), weight 47 moves on rod 48 to increase the distance $L_2$, and consequently, increase the rotational moment $WL_2$ with an increasing speed. This results in valve 3 pivoting with an increasing speed to fully close the second intake passage 2.

With the intake duct of the present embodiment, the valve 3 can be held fully open and fully closed automatically in accordance with the intake pressure, similar to Embodiment 1, reducing intake noise and ensuring the necessary amount of intake air can be both effected without using any resonator or the like. Furthermore, valve 3 pivots between the fully open state and fully closed state thereof with an increasing speed. Consequently, there is hardly time for a space to exist between the second intake passage 2 and valve 3. This arrangement prevents such a disadvantage as the generation of low frequency booming noise which has been encountered with the comparative examples. The intake duct of the present embodiment has a simple arrangement requiring no electronic control or diaphragm actuator, exhibits high reliability and can be produced at a low cost.

(Embodiment 3)

Figure 5:
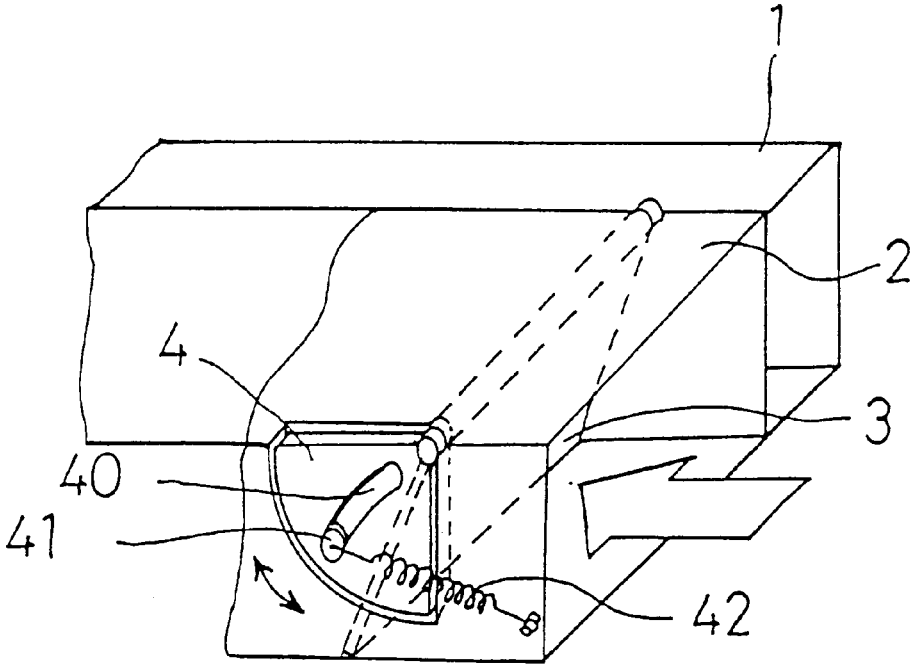
FIG. 5 is a diagram illustrating the arrangement of a third embodiment of an intake duct in accordance with the present invention.

In the preceding embodiments, cam 4 used has a disk-like configuration and is secured to the pivot shaft of the valve 3, which is a conceptual arrangement. Practically, as shown in FIG. 5, a sector-shaped cam 4 is provided on one of the side walls defining the second intake passage 2 integrally with a valve 3, and one end of a spring 42 is secured to a wall partly defining the second intake passage 2. In this present embodiment, since cam 4 pivots with valve 3, torque is directly transmitted to cam 4 from valve 3. This arrangement eliminates looseness between the parts, and consequently, disadvantages such as operation lag are prevented. Furthermore, the number of parts is decreased so that production costs are reduced.

Figure 6:
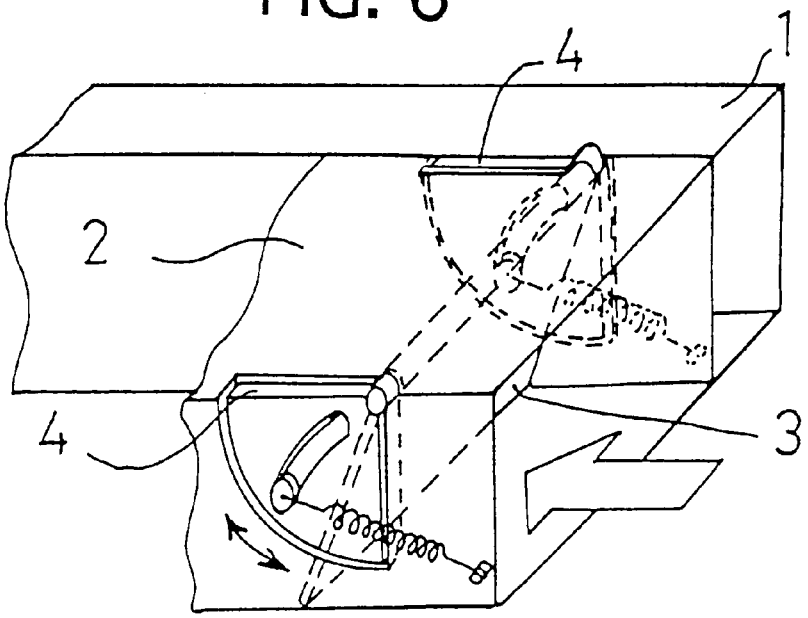
FIG. 6 is a diagram illustrating a modification of the third embodiment of the present invention.

With the arrangement illustrated in FIG. 6, wherein a sector-shaped cam 4 is provided on each of side walls defining the second intake passage 2, and a spring 42 is provided in each cam 4, the pivotal movement of a valves can be more accurately controlled.

Figure 7:
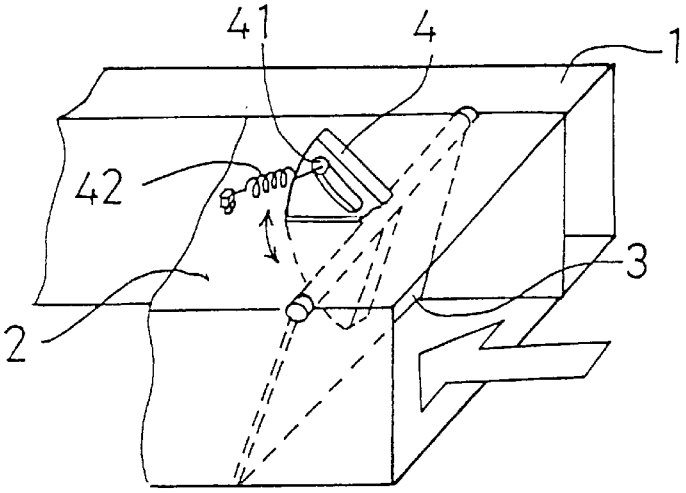
FIG. 7 is a diagram illustrating another modification of the third embodiment of the present invention.

With the arrangement illustrated in FIG. 7, wherein a sector-shaped cam 4 is provided about the central part of the second intake passage 2 so as to project into the second intake passage 2 and retract therefrom, only a single cam 4 and a single spring 42 enable the accurate pivotal movement of the valves.

(Embodiment 4)

In the preceding embodiments, spring 42 is connected to only one end of the slide pin 41, and consequently, the shaft thereof may be inclined with respect to the wall defining the slot 40 to increase the resistance against the movement of the slide pin 41 in the slot 40, whereby sure operation cannot always be obtained.

Figure 8:
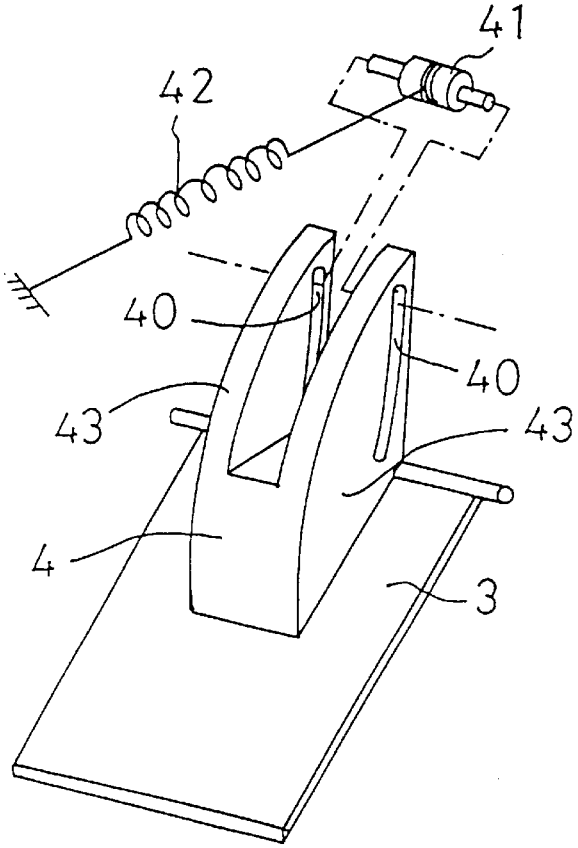
FIG. 8 is a diagram illustrating the arrangement of a fourth embodiment of an intake duct in accordance with the present invention.

To overcome the above-described disadvantage, with the present embodiment, as illustrated in FIG. 8, a cam 4 is formed integrally with valve 3 and includes a pair of facing, spaced apart plate sections 43 and a slot 40 formed in each of the plate sections 43. The slide pin 41 is disposed between the plate sections 43 such that both ends thereof move in the slots 40, respectively. One end of the spring 42 is attached to the longitudinal center of the slide pin 41. With this arrangement, both ends of the slide pin 41 can move in the slots 40 uniformly so that the resistance generated by the slide pin 41 moving in the slots 40 is reduced, effecting reliable operation.

(Embodiment 5)

Figure 9:
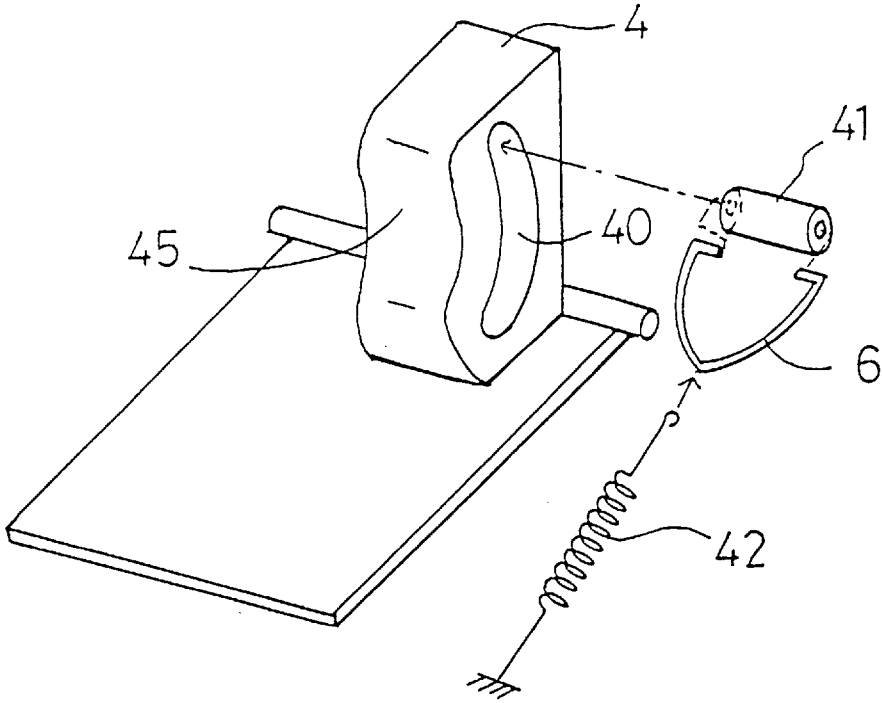
FIG. 9 is a diagram illustrating the arrangement of a fifth embodiment of an intake duct in accordance with the present invention.

In the present embodiment, which is illustrated in FIG. 9, a spring 42 is attached to a ring member 6 of which both ends are respectively provided in opposite ends of a slide pin 41. A cam 4 has a concave portion 45 which allows for movement of the ring member 6.

In this present embodiment, the biasing force of the spring 42 uniformly acts on both ends of the slide pin 41 via the ring member 6. This results in both ends of the slide pin 41 moving under the same force in the slot 40, and consequently, the resistance generated when the slide pin 41 moves in the slot 40 is reduced, effecting a reliable operation.

Figure 10:
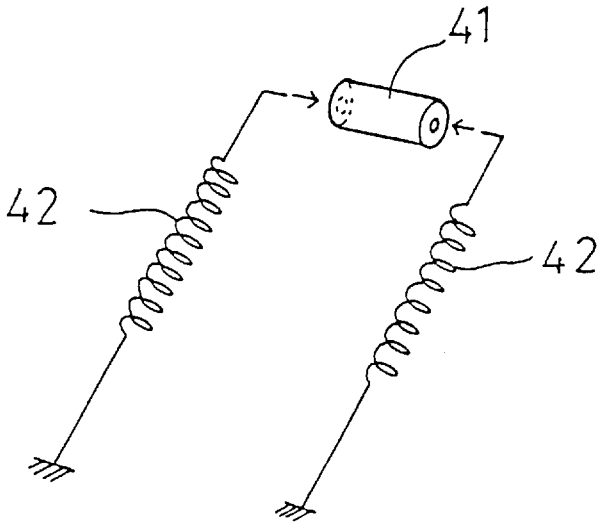
FIG. 10 is a diagram illustrating a modification of the fifth embodiment of the present invention.

Furthermore, as illustrated in FIG. 10, with the arrangement wherein two springs 42 are attached to opposite ends of a slide pin 41, respectively, (which is applied to the intake ducts illustrated in FIGS. 5 through 9), operational advantages similar to those of the preceding embodiments can be effected.

(Embodiment 6)

When the intake pressure increases and valve 3 starts to pivot, valve 3 first pivots slowly in accordance with the increase in the engine speed, and next, pivots with an increasing speed to fully open the second intake passage 2. At the beginning of the pivotal movement of valve 3, there is a short period of time during which valve 3 is slightly open, allowing for intake noise to leak through any gap that exists between the wall defining the second intake passage and valve 3, which is a disadvantage.

Figure 11:
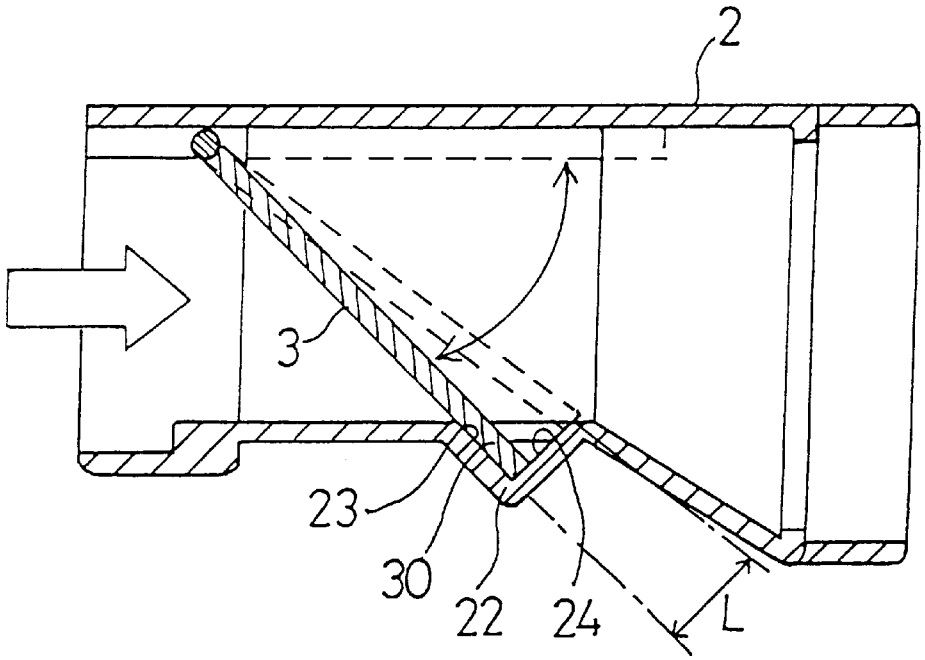
FIG. 11 is a diagram illustrating the arrangement of a sixth embodiment of an intake duct in accordance with the present invention.

The present embodiment, as illustrated in FIG. 11, overcomes the above disadvantage by providing a concave portion 22 having a triangular section in a bottom wall defining the second intake passage 2 such that a pivotal or free end 30 of valve 3 is accommodated and received therein. The concave portion 22 is defined by a stopper face 23 adapted to stop and engage with the pivotal end 30 of valve 3 when valve 3 pivots to its fully closed position, and a guide face 24 along which the end face of the pivotal end 30 is guided when valve 3 pivots. The width L of the guide face 24 corresponds to the moving distance of the pivotal end face of the valves while the valves pivots slowly.

Other arrangements are possible similar to those of embodiments 1 to 5.

With the intake duct of the present embodiment, when valve 3 first pivots slowly in accordance with the increase in the engine speed, the pivotal end 30 of valve 3 moves along the guide face 24 to prevent the generation of a gap between valve 3 and second intake passage 2, thereby, preventing the leakage of intake noise through such a gap.

With an arrangement wherein the guide face 24 has a circular arc-like section, the center of which exists in the pivotal shaft of valve 3, the gap between the pivotal end 30 of valve 3 and guide face 24 can be further decreased, and consequently, leakage of the intake noise through the above-described gap can be prevented with more certainty. In addition, it is preferable to bond an unwoven fabric or the like to an outer surface of the valve 3, which slides on the wall defining the second intake passage 2. With this arrangement, the clearance between valve 3 and the wall defining the second intake passage 2 can be adjusted to prevent, the leakage of intake noise caused by the generation of the above-described gap as well as impact noise caused by loose parts.

Figure 12:
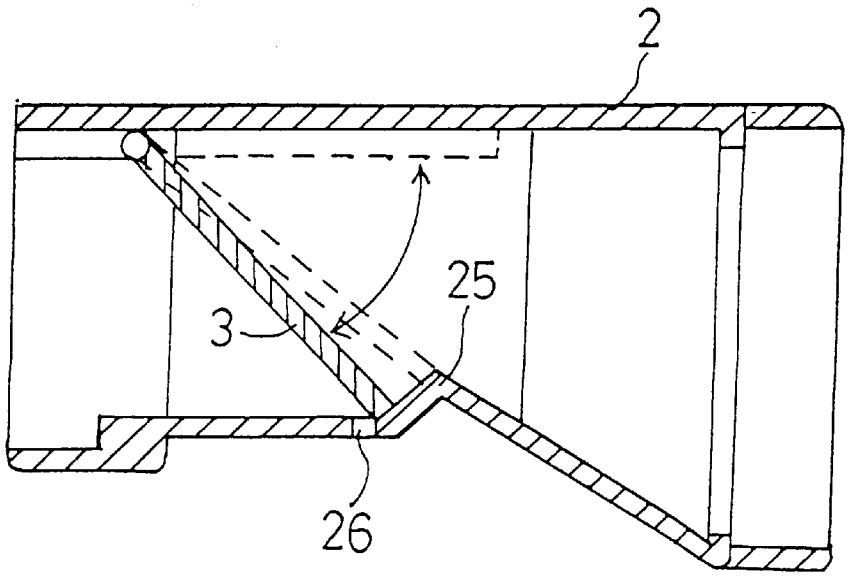
FIG. 12 is a diagram illustrating a modification of the sixth embodiment of the present invention.

In the present embodiment, the concave portion 22 is provided in the second intake passage 2. Alternatively, as illustrated in FIG. 12, a projection 25 having a triangular section may be provided therein. The projection 25 achieves operational advantages similar to those of the concave portion 22.

In the embodiment illustrated in FIG. 12, a hole 26 is bored through a bottom wall defining the second intake passage 2. With this arrangement any moisture, adhering to the valve 3 and/or the wall defining the second intake passage 2, can be discharged via the hole 26. Consequently, problems caused by the adherence moisture can be controlled.

(Embodiment 7)

In situations where the valve 3 opens slightly, vibrations may be generated therein to cause an unpleasant noise. This happens because intake air rapidly passes through a small sectional area, defined between valve 3 and second intake passage 2, and also because the difference between the biasing force of the spring 42 and intake pressure is small, valve 3 may be is held slightly open for a comparatively long period of time, resulting in intake pulsation from the engine body being readily transmitted to and vibrating valve 3.

Figure 13:
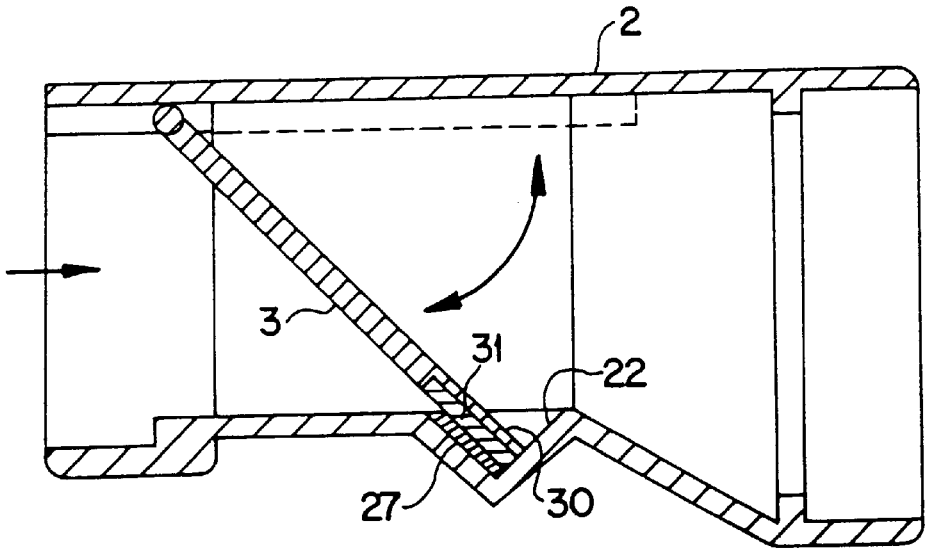
FIG. 13 is a longitudinal sectional view of a main part of a seventh embodiment of an intake duct in accordance with the present invention.

To overcome this disadvantage, as illustrated in FIG. 13, a permanent magnet 27, having a predetermined magnetic force, is disposed in the concave portion 22 of the intake duct of Embodiment 6, to face valve 3. If needed, an iron piece 31 can be joined to a surface of a pivotal end 30 of valve 3, which faces the permanent magnet 27.

Other compositions similar to those of embodiments 1 to 5 are also possible.

When, in this arrangement, the differential pressure between the biasing force of the spring 42 and intake pressure is small, the iron piece 31 is attracted by the permanent magnet 27, and valve 3 abuts the concave portion 22 to close the second intake passage 2. When the intake pressure increases such that the differential pressure between the biasing force of the spring 42 and the intake pressure exceeds the attracting force of the permanent magnet 27 on the iron piece 31, valve 3 separates from the concave portion 22, and pivots rapidly to open the second intake passage 2.

Thus, the intake duct of the present embodiment enables the time period in which there is a small sectional area formed between valve 3 and second intake passage 2 can be shortened greatly, whereby noise due to the vibrations of valve 3 can be prevented if not eliminated.

In the present embodiment, the permanent magnet 27 is disposed in the concave portion 22 while the iron piece 31 is joined to valve 3. Alternatively an iron piece may be disposed in the concave portion 22 while a permanent magnet is joined to valve 3, achieving the same operational advantages. Furthermore, an electromagnet may be used in place of the permanent magnet. In addition, the permanent magnet 27 and iron piece 31, can be affected by various well known means such as, for example, insert-molding or adhesive bonding.

Figure 14:
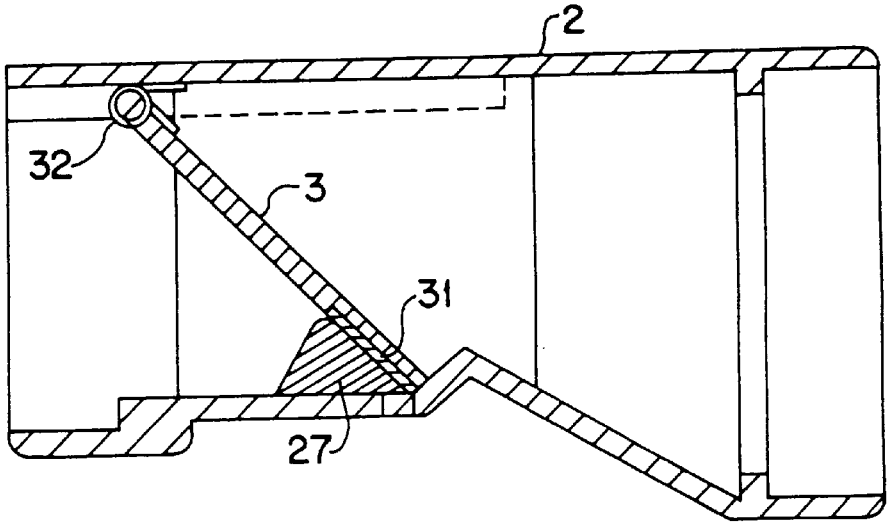
FIG. 14 is a longitudinal sectional view of a main part of an eighth embodiment of an intake duct in accordance with the present invention.

Furthermore, if the permanent magnet 27 is formed with a generally triangular sectional shape, as illustrated in FIG. 14, the surface of the permanent magnet 27 can be used in place of the engaging face 23 of the concave portion 22.

(Embodiment 8)

In Embodiment 7, a magnet force was used to prevent the generation of valve vibrations. As illustrated in FIG. 14, a return spring 32 may be further provided in the pivot shaft of the valve 3 so as to bias valve 3 continuously in such a direction as to close the second intake passage 2.

By determining the biasing force of the return spring 32 to be a predetermined value, valve 3 is pressed on the permanent magnet 27 with the biasing force of the return spring 32 when the differential pressure between the biasing force of the spring 32 and intake pressure is small, whereby the valve 3 closes the second intake passage 2. When the intake pressure increases and the differential pressure between the biasing force and intake pressure exceeds the total of the biasing force of the return spring 32 and magnetic force of the permanent magnet 27, the valve 3 separates from the permanent magnet 27 and pivots rapidly to open the second intake passage 2.

Consequently, with the intake duct of the present embodiment, the time period in which a small space is formed between valve 3 and second intake passage 2 can be shortened greatly so that the generation of noise due to the vibrations of the valves can be prevented.

In the present embodiment, both the spring force of the return spring 32 and magnetic force are used. Of course, merely the spring force of the return spring 32 can achieve approximately the same result.

(Embodiment 9)

Instead of the magnetic force or biasing force of the return spring, a resistance force with a damper can also be used. For example, as illustrated in FIG. 15, a pair of gears 39 and 33 which mesh with each other are provided on the pivot shaft of valve 3 and a side wall defining a second intake passage 2, respectively. A damper mechanism 34 is provided inside one or both of the gears 39 and 33. In the arrangement of FIG. 15, the damper mechanism 34 is provided inside the gear 33 provided in the side wall defining the second intake passage 2.

Other compositions similar to the of embodiments 1 to 5 are possible.

By determining the resistance force of the damper mechanism 34 to be a predetermined value, valve 3 is prevented from opening with the resistance force of the damper mechanism 34 when the differential pressure between the biasing force of the spring 42 and intake pressure is small, whereby valve 3 contacts the concave portion 22 and closes the second intake passage 2. When the intake pressure increases and the differential pressure between the biasing force of the spring 42 and intake pressure exceeds the resistance force of the damper mechanism 34, valve 3 separates from the concave portion 22 and pivots rapidly to open the second intake passage 2.

Consequently, with the intake duct of the present embodiment, the time period in which a space having a small sectional area is formed between the valve 3 and second intake passage 2 is greatly shortened, thereby preventing or lessening the generation of noise due to the vibrations of the valves.

(Embodiment 10)

In the intake duct of Embodiment 9, the resistance force of the damper mechanism 34 is continuously exerted on the valves so that the disadvantage in the response characteristic of valve 3 decreases.

To overcome this disadvantage, in the present embodiment, as illustrated in FIG. 16, one of the two gears 39 and 33 (gear 39 in FIG. 16) is composed of a gear having teeth partly formed along the periphery thereof such that the resistance force of the damper mechanism 34 is exerted only from the time the valve 3 abuts the surface of the concave portion 22 until the valves separates slightly therefrom.

Thus, with the intake duct of the present embodiment, operational advantages similar to those of Embodiment 9 can be achieved, and the response characteristic of valve 3 can be made approximately identical to those of other embodiments.

Of course, in an arrangement where, as illustrated in FIG. 17, teeth 46 are partly provided along the periphery of a cam 4 of the intake duct illustrated in FIG. 1 or the like, and a damper mechanism 34 having teeth adapted to mesh with the teeth 46 is provided in the side wall defining the second intake passage 2, or the like, similar operational advantages can be achieved.

(Embodiment 11)

Figure 18:
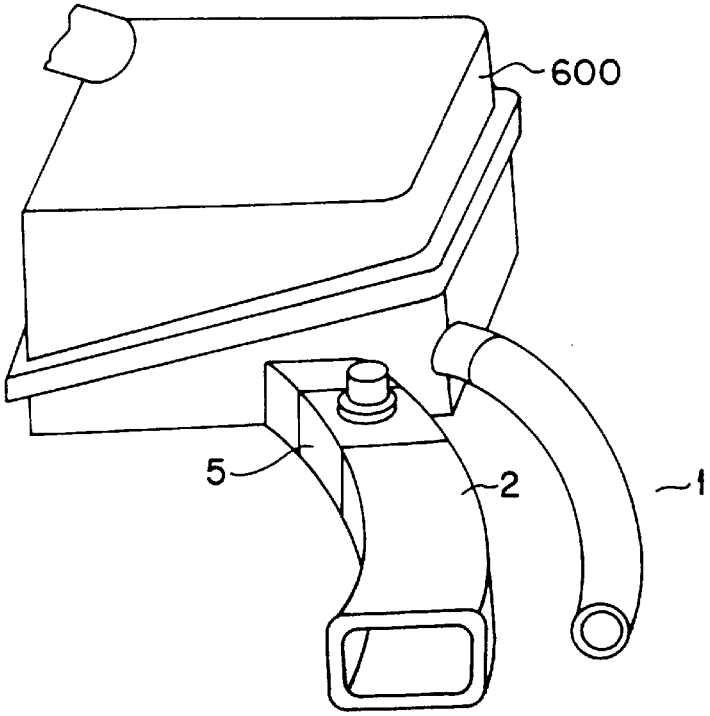
FIG. 18 is a perspective view illustrating the arrangement of an eleventh embodiment of an intake duct in accordance with the present invention.

FIG. 18 is a diagram explaining the construction of the intake duct of this embodiment. As shown, the intake duct has a first intake passage 1, having a small diameter, a second intake passage 2 having a diameter or cross-sectional area greater than that of the first intake passage 1, and an air cleaner casing 600 to which the first intake passage 1 and second intake passages are connected, respectively.

The cross-sectional area of the first intake passage 1 corresponds to that of a pipe Ø40 while the cross-sectional area of the second intake passage 2 corresponds to that of a pipe Ø70. And a valve adjusting section 5 is provided in the second intake passage 2.

Figure 19:
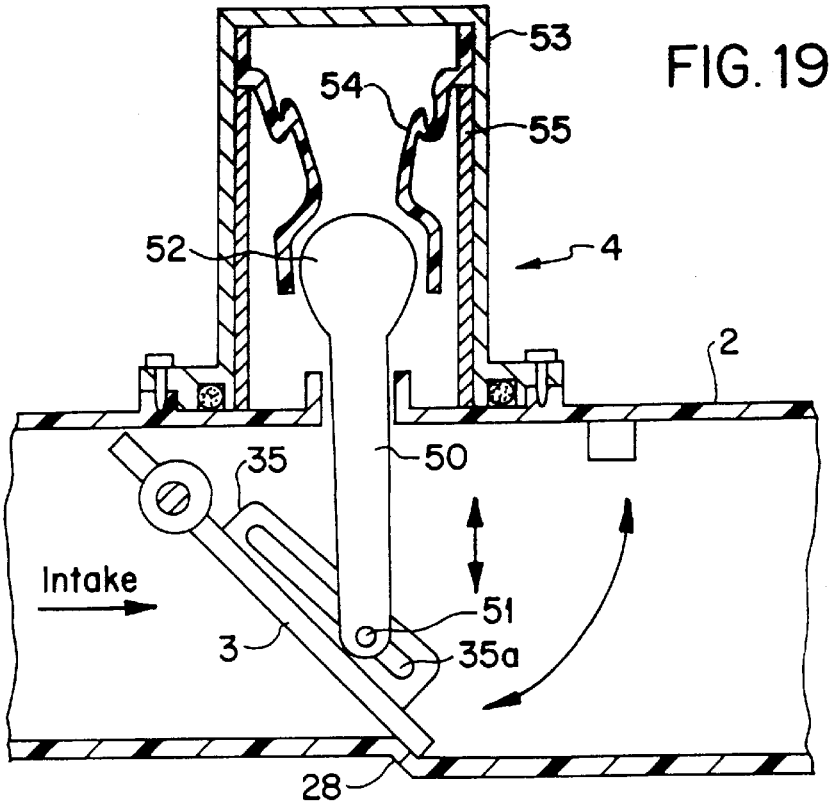
FIG. 19 is a longitudinal sectional view of a main part of the eleventh embodiment at the time a valve is in the full-closed position.
Figure 20:
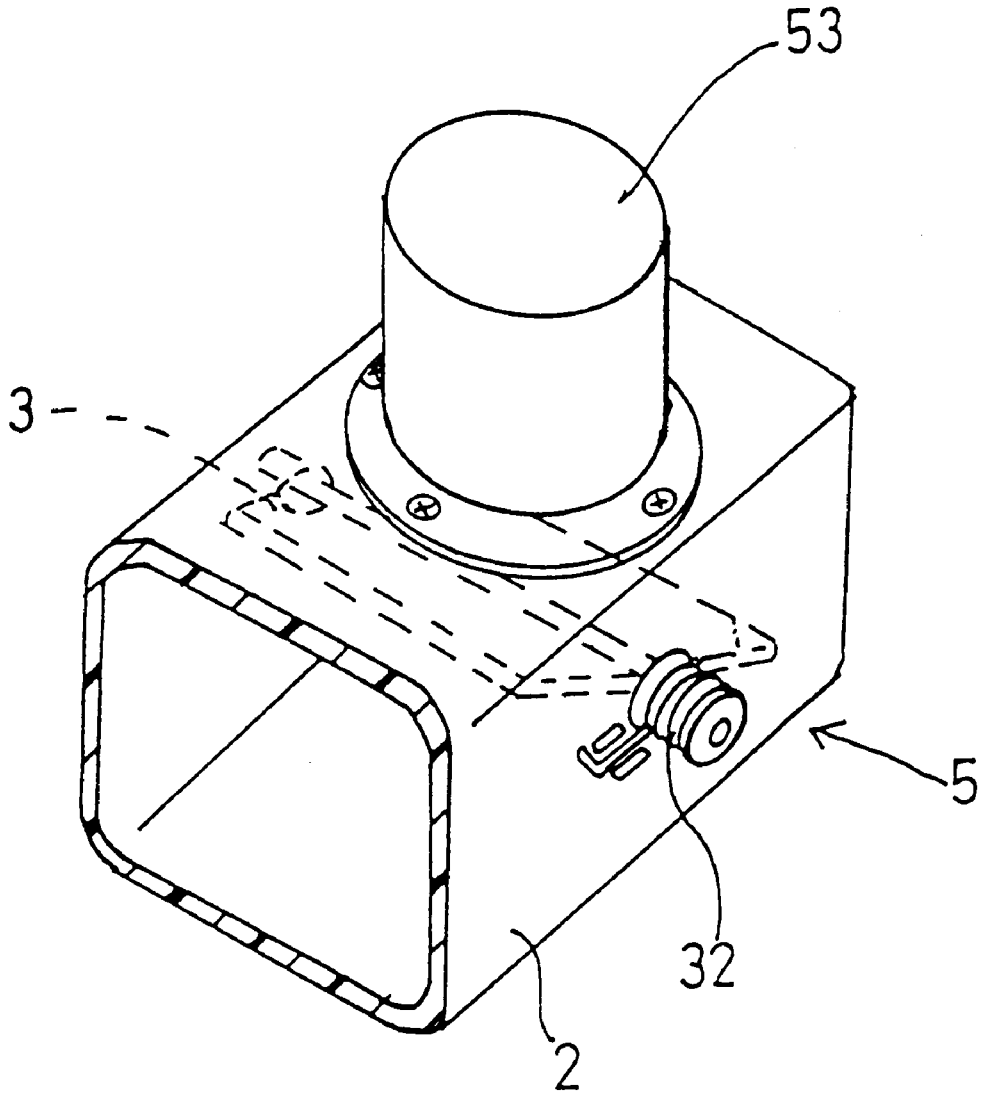
FIG. 20 is a perspective view of a main part of the eleventh embodiment of the present invention.

As illustrated in FIG. 19, in the valve adjusting section 5, a valve 3 is pivotally provided on the wall defining the second intake passage 2. As illustrated in FIG. 20, a return spring 32 is provided at one end of a pivot shaft of the valve 3 to bias the valve 3 in such a direction as to continuously close the second intake passage 2. A pivotal end of valve 3 is adapted to abut a step 28 formed in the second intake passage 2, as shown in FIG. 19.

A guide 35 having a slot 35*a* is formed on the surface of valve 3 so as to extend at right angles to the pivot shaft of valve 3. One end of a pin 50 is slidably engaged in the slot 35*a* via a pin 51. This results in the pin 50 being pivotable with respect to valve 3 via pin 51. The other end of pin 50, which defines a larger diameter part 52, penetrates an upper wall defining the second intake passage 2 and projects outwardly. A cover 53 is secured air tight to the upper wall defining the second intake passage 2 so as to cover the projecting larger diameter part 52 of pin 50.

Figure 21:
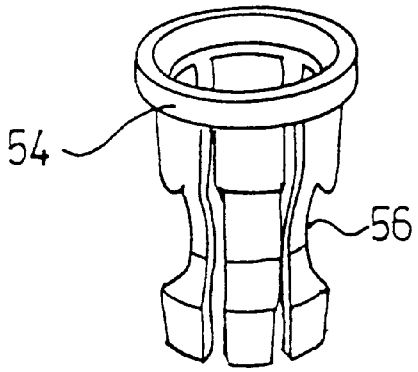
FIG. 21 is a perspective view of a clip used in the eleventh embodiment of the present invention.

A clip 54, illustrated in FIG. 21, is secured inside the cover 53 such that the downward movement thereof is limited by a bushing 55. The clip 54 is formed so as to engage with and disengage from the larger diameter part 52 of the pin 50. The longitudinal cross-section of clip 54 is designed to restrain the movement of the larger diameter part 52 to the inside of clip 54 and facilitate movement thereof to the outside of clip 54.

Figure 22:
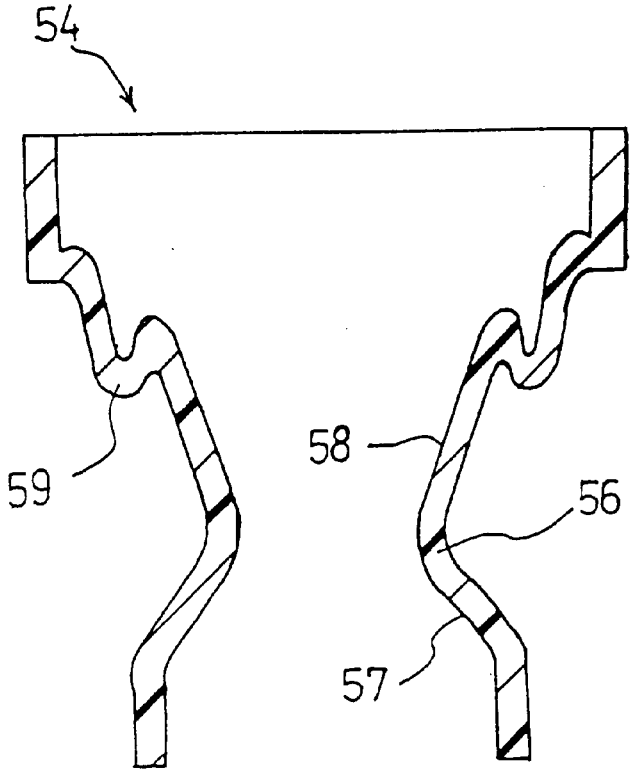
FIG. 22 is a longitudinal sectional view of the clip used in the eleventh embodiment of the present invention.

More specifically, as illustrated in FIG. 22, clip 54 has a narrow part 56 in the longitudinal center thereof. A lower taper face 57 is formed below the narrow part 56 such that the diameter gradually enlarges downwardly, and an upper taper face 58 is formed above the narrow part 56 such that the diameter thereof enlarges upwardly. Above the upper taper face 58, a bend part 59 which bends downwardly is formed.

When the larger diameter part 52 enters clip 54, the larger diameter part 52 presses the lower taper face 57 and enlarges the diameter of the narrow part 56. At this time, the bend part 59 deforms only slightly so that when the larger diameter part 52 enters the clip 54 it receives a large resistance from the bent part 59. However, when the larger diameter part 52 which has entered the clip 54 leaves the same, the larger diameter part 52 presses the upper taper face 58 to enlarge the diameter of the narrow part 56 and also deform the bend part 59 elastically in such a direction as to enlarge the diameter thereof. Consequently, when the larger diameter part 52 leaves the clip 54, both the narrow part 56 and bend part 59 deform elastically so that clip 54 deforms elastically with ease, as compared to the case where the larger diameter part 52 enters clip 54. Thus, the larger diameter part 52 leaves clip 54 readily.

With the intake duct thus arranged, when the intake pressure is smaller than a predetermined value, as illustrated in FIG. 19, the pivotal end of valve 3 is pressed against step 28 with the biasing force of the return spring 32 to close the second intake passage 2. This results in intake air being introduced only through the first intake passage 1 having a smaller diameter to increase the acoustic mass. Thus, the low frequency intake noise is reduced without using any resonator or the like. At this time, the larger diameter part 52 of the other end of pin 50 is located within the lower taper face 57 of clip 54.

When the intake pressure becomes greater than the biasing force of the return spring 32 and valve 3 is about to start to pivot, the larger diameter part 52 of pin 50 presses the lower taper face 57 of clip 54 to deform the narrow part 56 elastically to enlarge the diameter thereof. Thus, until the intake pressure increases to some degree, the elastic force of clip 54 acts as a reactive force to restrain the pivotal movement of valve 3.

When the intake pressure exceeds a predetermined value, and valve 3 pivots rapidly, pin 50 is guided in the guide 35 to move upwardly, and the larger diameter part 52 elastically deforms the narrow part 56 of clip 54 to enlarge the diameter thereof, and gets over the narrow part 56 to reach the inside of the upper taper face 58. Since pin 50 moves upwardly but with the upward movement being restrained in this manner, the fluttering of valve 3 is also restrained. After the larger diameter part 52 gets over the narrow part 56, the elastic reactive force exerted with clip 54 disappears so that valve 3 pivots rapidly into the full-open state where valve 3 is generally parallel to the extending direction of the second intake passage 2. Thus, the second intake passage 2 is fully opened. On the other hand, clip 54 returns to its original state.

This results in intake air being introduced mainly through the second intake passage 2 having a large diameter and short length. Consequently, disadvantages such as reduced air intake are overcome. Furthermore, the intake noise is mixed with the engine noise so that the intake noise is not perceived as an unpleasant noise.

When the intake pressure decreases again, the valves pivots due to the biasing force of the return spring 32, and the larger diameter part 52 presses the upper taper face 58 of clip 54. This results in both the narrow part 56 and bend part 59 deforming elastically so that the larger diameter part 52 of clip 54 fits over the narrow part 56 readily. Thus, valve 3 also moves readily. Consequently, valve 3 is pressed on step 28 quickly with the biasing force of the return spring 32 to close the second intake passage 2. This enables the time period during which a gap exists between the second intake passage 2 and valve 3 to be shortened, and also prevents the generation of low frequency booming noise due to leakage of the intake noise through the gap.

With the intake duct of the present embodiment, valve 3 can be held in its fully-open state and fully-closed state automatically in accordance with the intake pressure. Consequently, both the reduction of the intake noise and ensuring of a necessary amount of intake air can be effected without using any resonator or the like. In addition, the intake duct of the present embodiment has a simple construction which does not require any electronic control, diaphragm actuator or the like. Thus, reliability can be enhanced, and production costs decreased.

In this embodiment, the configuration of the clip 54 was used as the valve adjusting means. Alternatively, the larger diameter part 52 of pin 50 may be formed as the valve adjusting means into a configuration wherein a front end thereof has a curved face having a large radius of curvature, and a rear end thereof has a curved face having a small radius of curvature. With this arrangement, when the larger diameter part 52 enters clip 54, resistance can be increased, and when the larger diameter part 52 leaves clip 54, resistance can be decreased, restraining the pivotal movement of valve 3 when valve 3 opens the second intake passage 2, and facilitating the pivotal movement of valve 3 when it closes the second intake passage 2.

(Embodiment 12)

Figure 23:
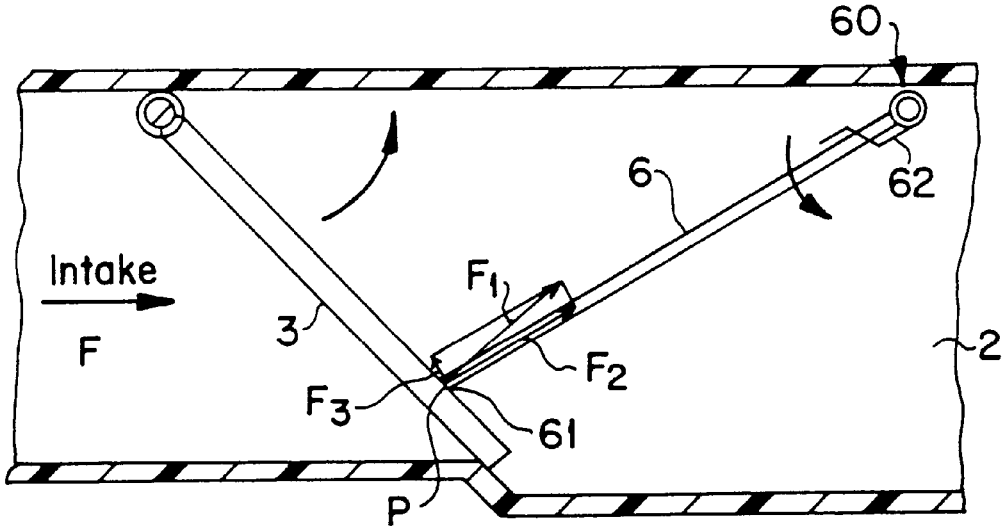
FIG. 23 is a longitudinal sectional view of a main part of a twelfth embodiment of an intake duct in accordance with the present invention at the time a valve is in the fully closed position.

FIG. 23 illustrates a twelfth embodiment of an intake duct in accordance with the present invention. As shown, the intake duct includes a valve 3 which is pivotally disposed in the second intake passage 2, and a stay 6 which is also pivotally disposed in the second intake passage 2. The first intake passage 1 and air cleaner casings are arranged similar to Embodiment 11.

One end 60 of the stay 6 is pivotally journaled to a side wall defining the second intake passage 2 while an end face of the other end 61 of stay 6 abuts valve 3. A coil spring 62 is provided of the journaled end 60 of stay 6. With the coil spring 62, stay 6 is biased so as to pivot towards the pivotal end of valve 3 in a direction at right angles to the pivot shaft of the valves.

With the intake duct of the present embodiment thus arranged, when the intake pressure in the second intake passage 2 is smaller than a predetermined value, valve 3 is pressed down by stay 6 by the biasing force of coil spring 62. Consequently, as illustrated in FIG. 23, the second intake passage 2 is closed with the end of the stay 6 abutting valve 3 in the vicinity of the pivotal end of valve 3.

When the force $F_1$ is exerted on valve 3 at the point (P), where the front end of stay 6 abuts with a force F of the intake pressure, component forces $F_2$ and $F_3$ are exerted on stay 6. By setting the biasing force of the coil spring 62 exerted on the point (P) to be greater than $F_3$, the pivotal movement of valve 3 is restrained with by stay 6 holding the second intake passage 2 closed. This results in intake air being introduced only through the first intake passage 1 having a small diameter to increase the acoustic mass. Consequently, low frequency intake noise is reduced without using any resonator or the like.

More specifically, until the intake pressure increases to some degree, the biasing force of coil spring 62 exerted on the point (P) acts as a reaction force to restrain the pivotal movement of valve 3 via stay 6. This arrangement effectively prevents noise from being generated when the engine runs at a low speed, and restrains fluttering of the valves 3.

Figure 24:
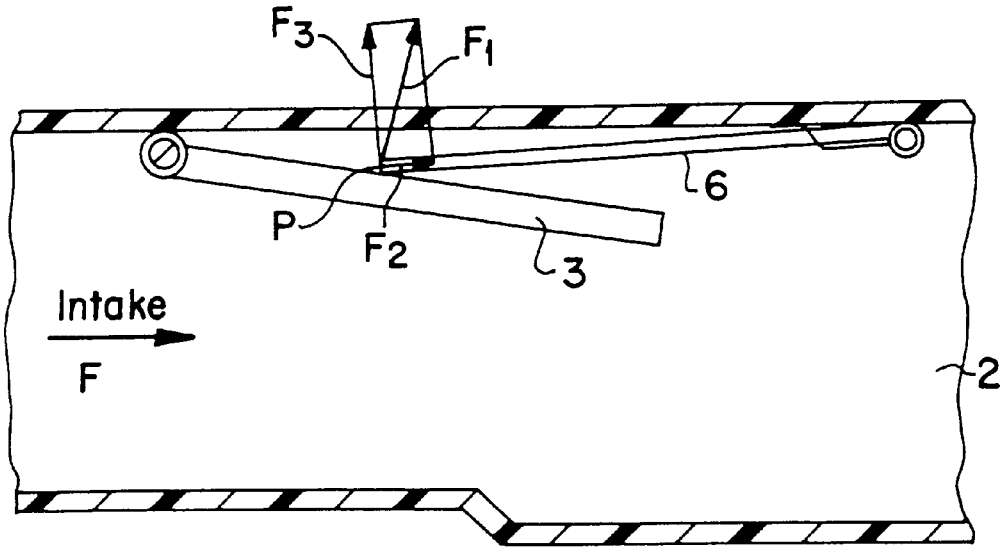
FIG. 24 is a longitudinal sectional view of a main part of a twelfth embodiment of an intake duct in accordance with the present invention at the time a valve is in the fully closed position.

When the component force $F_3$ of the intake pressure F increases and becomes greater than the biasing force of coil spring 62, which is exerted on the point (P), valve 3 starts to pivot opening the second intake passage 2, as illustrated in FIG. 24. At this time, the component force $F_3$ of the intake pressure, which is greater than the biasing force of the coil spring 62, is exerted on stay 6 so that valve 3 opens the second intake passage 2.

Thus, intake air for the engine is introduced mainly through the second intake passage 2 having a large diameter and a short length so that disadvantages such as a reduced amount of intake air is overcome. Furthermore, the intake noise is mixed with engine noise so as to not be perceived as an unpleasant noise.

When the intake air decreases again, valve 3 is pressed down by stay 6 with the biasing force of the coil spring 62. As valve 3 pivots, the second intake passage 2 is closed.

With the intake duct of the present embodiment, valve 3 can be held in its fully-open state and fully-closed state automatically in accordance with the intake pressure, similar to Embodiment 11. Consequently, both the reduction of intake noise and the ensuring of a necessary amount of intake air can be effected without using a resonator or the like. In addition, the intake duct of the present embodiment has a simple construction which does not require any electronic control or diaphragm actuator. Consequently, reliability can be enhanced, and production costs decreased.

In the present embodiment, stay 6 and coil spring 62 are used as the valve adjusting means. In the case where the stay 6 is composed of a spring steel or the like, a biasing force is obtained by the stay 6 itself so that operational advantages similar to those of the present embodiment can be obtained without using a coil spring.

Furthermore, in the present embodiment, the stay 6 and coil spring 62 are provided in the second intake passage 2. Alternatively, any other member which moves with the pivotal movement of valve 3 may be provided outside the second intake passage 2. With this arrangement, stay 6 and coil spring 62 can be provided outside the second intake passage 2.

(Embodiment 13)

Figure 25:
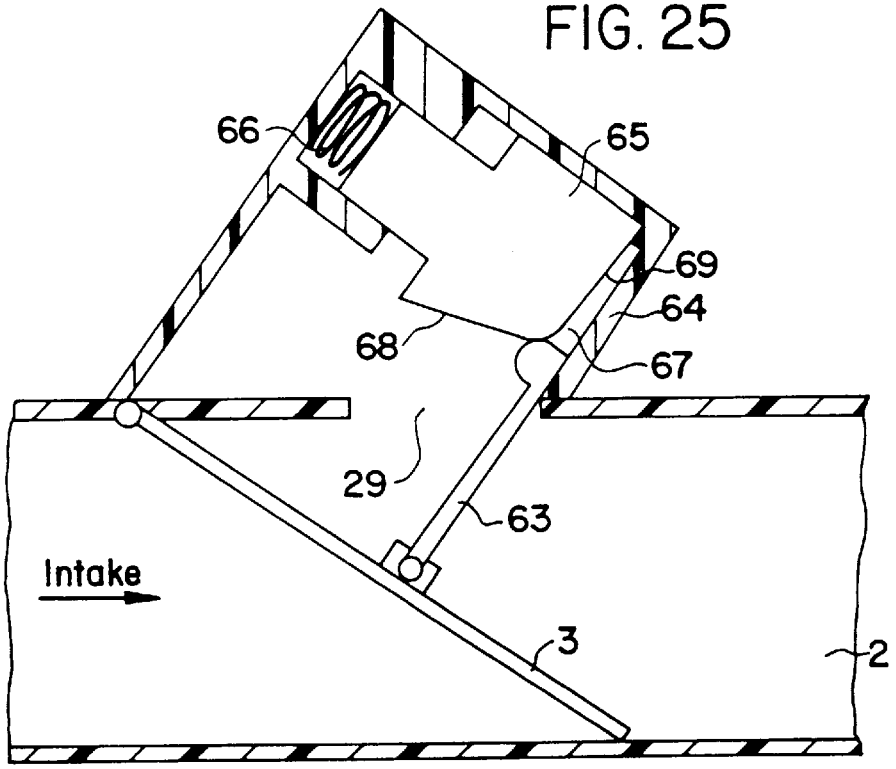
FIG. 25 is a longitudinal sectional view of a main part of a thirteenth embodiment of an intake duct in accordance with the present invention at the time a valve is in the fully closed position.

FIG. 25 illustrates the intake duct of the thirteenth embodiment of the present invention. As shown, the intake duct includes a valve 3 pivotally disposed in the second intake passage 2. A rod 63 is supported by the valve 3 so as to be pivotable at right angles to the pivot shaft of valve 3. Rod 63 projects upwardly out of the second intake passage 2 through a slit 29 provided in an upper wall defining part of the second intake passage 2. A cover 64 is secured in an air tight manner to an outer surface of the upper wall defining the second intake passage 2 in the inclined state to cover the projecting rod 63. The first intake passage 1 and air cleaner casing 600 are constructed similar to Embodiment 11, but the valve 3 is not provided with a return spring.

A cam 65 is provided inside the cover 64 via a spring 66 such that an end of the rod 63 is engaged in a space having a wedge-like section, defined between the cam 65 and cover 64. The end of the rod 63 has a curved face so as to smoothly move in the space 67.

The cam 65 has a first tapered face 68 in a surface facing the rod 63, and a second tapered face 69 in an endface continuous with the first tapered face 68. The space 67 is a wedge-like section of upwardly decreasing width and is defined between the second tapered face 69 and inner face of the coyer 64. The spring 66 biases the cam 65 in such a direction as to decrease the width of the space 67.

When the intake pressure in the second intake passage 2 is smaller than a predetermined value, the end of rod 63 is ejected or pushed from space 67 with the biasing force of the spring 66 and valve 3 is held closed. When the intake pressure increases and the valve 3 is about to pivot in such a direction as to open the second intake passages, the valves is held closed by the biasing force of the spring 66 which is greater than the force urging the rod 63 to enter the space 67.

When the intake air increases further, the rod 63 enters the space 67 against the biasing force of the spring 66 to press against and now cam 65, and enter the space 67 a further distance. This results in valve 3 pivoting with the intake pressure while being restrained by the biasing force of the spring 66 to open the second intake passage 2. Thus, intake air is introduced mainly through the second intake passage 2 due to its larger diameter and shorter length and thereby provides sufficient intake air. Additionally, any intake noise is mixed with engine noise so that it is not perceived as an unpleasant noise.

When the intake air decreases again, the end of the rod 63 is once again pushed out of the space 67 by the biasing force of the spring 66, whereby valve 3 pivots readily to again close the second intake passage 2.

With the intake duct of the present embodiment, the valve 3 can be held in the full-open state and full-closed state automatically in accordance with the intake pressure, similar to Embodiment 11. Consequently, both the reduction of intake noise and the assurance of a necessary amount of intake air can be effected without using a resonator or the like. In addition, the simple construction of the intake duct of the present embodiment does not require any electronic control or diaphragm actuator, and consequently, the reliability can be enhanced, and production costs decreased.

Figure 26:
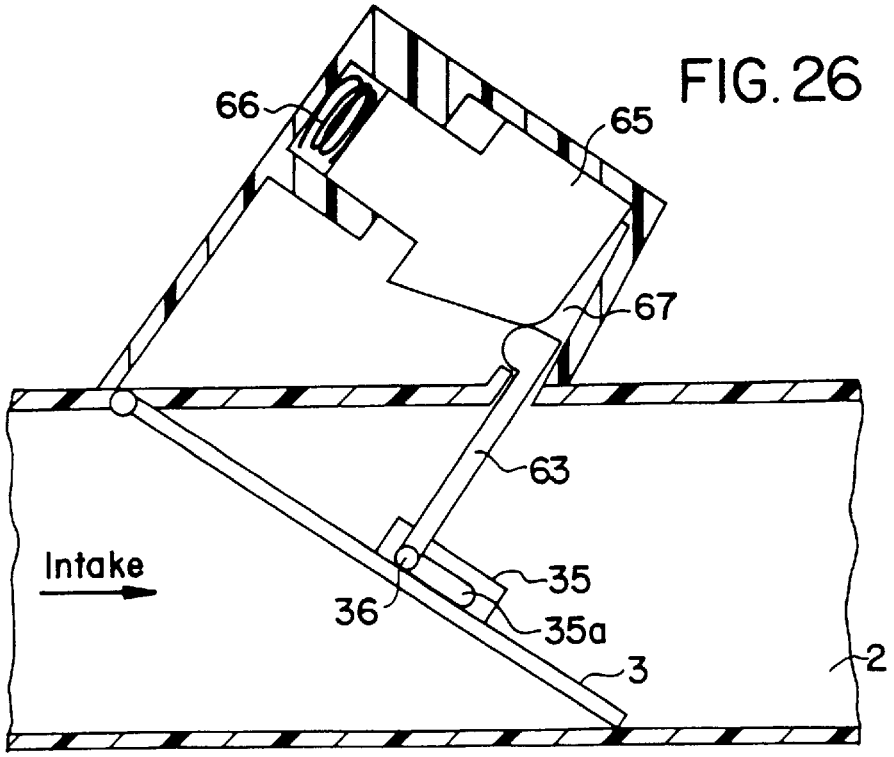
FIG. 26 is a longitudinal sectional view of a main part of a modification of the thirteenth embodiment of the present invention et the time a valve is in the fully closed position.

As illustrated in FIG. 26, it is also preferable to form a guide 35 having a slot 35*a* in valve 3 such that one end of rod 63 is slidably supported in slot 35*a* via a pin 36. With this arrangement, the rod 63 can move into and out of the space 67 more smoothly to enable valve 3 to also pivot more smoothly. Since the area of the opening (slit 29) formed in the wall defining the second intake passage 2 can be reduced, the leakage of intake noise can be prevented with more certainty.

(Embodiment 14)

Figure 27:
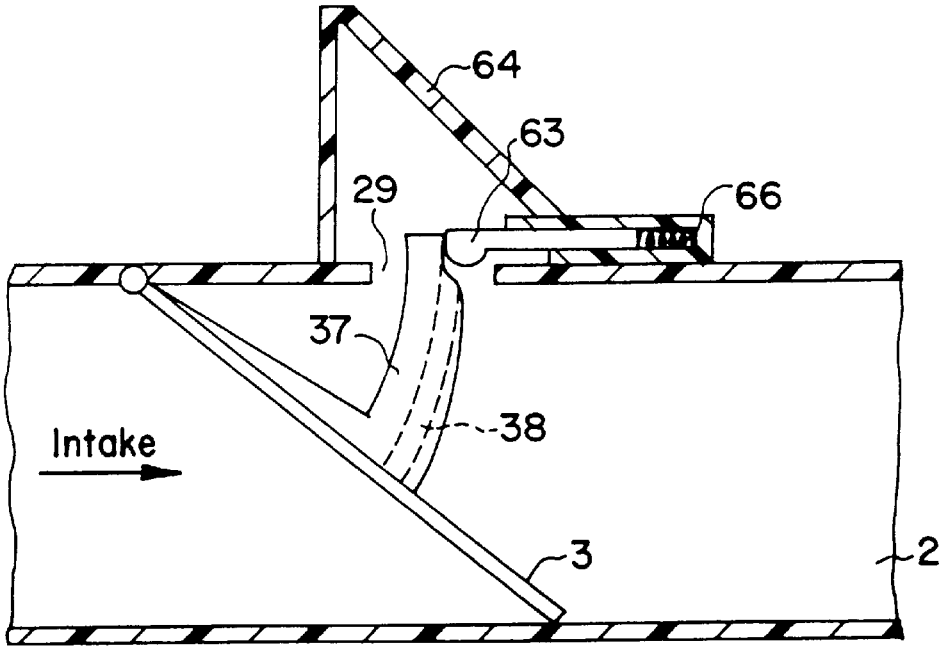
FIG. 27 is a longitudinal sectional view of a main part of a fourteenth embodiment of an intake duct in accordance with the present invention at the time a valve is in the fully closed position.

FIG. 27 illustrates the intake duct of this embodiment. As shown, the intake duct includes a valve 3 pivotally disposed in the second intake passage 2. A cam 37 having a circular arc-shaped guide rail 38 is provided so as to project from the valve 3. Cam 37 projects upwardly out of the second intake passage 2 through a slit 29 provided in an upper wall defining the second intake passage 2, and an air tight cover 64 is secured to an outer surface of the upper wall defining the second intake passage 2 to cover the projecting cam 37. The first intake passage 1 and air cleaner casing are constructed similarly to Embodiment 11, but no return spring is provided in valve 3. A rod 63 is provided inside cover 64 via a spring 66 so as to be movable frontwards and rearwards in the horizontal direction.

The end of rod 63 has a curved face and is pressed against the guide rail 38 for smooth movement. By designing the end of rod 63 and guide rail 38 to specific configurations, cam 37 moves downwardly when rod 63 presses cam 37 under the biasing force of spring 66.

When the intake pressure in the second intake passage 2 is smaller than a predetermined value, the end of rod 63 is pushed into the slit 29 with the biasing force of spring 66 pressing against cam 37. This results in cam 37 moving downwardly to hold valve 3 closed. When the intake pressure increases and valve 3 is about to pivot to open the second intake passage 2, valve 3 is held closed under the biasing force of the spring 66 which is greater than the force with which the intake air presses the end of the cam 37 towards the rod 63.

When the intake air increases further, cam 37 then ascends while the guide rail 38 presses rod 63 against the biasing force of the spring 66. This results in valve 3 pivoting under the intake pressure while being restrained by the biasing force of spring 66 to open the second intake passage 2. Thus, intake air is introduced mainly through the second intake passage 2, which has a large diameter and short length thereby preventing disadvantages such as a reduction in the amount of intake air. Also, the intake noise is mixed with the engine noise so that it is not perceived as en unpleasant noise.

When the intake pressure decreases again, the end of rod 63 presses cam 37 with the biasing force of spring 66. Thus, the valve pivots readily to close the second intake passage 2.

With the intake duct of the present embodiment, valve 3 can be held in the fully-open state and fully-closed state automatically in accordance with the intake pressure similar to Embodiment 11. Consequently, both the reduction of intake noise and the assurance of a necessary amount of intake air can be effected without using a resonator or the like. In addition, the simple construction of the intake duet of the present embodiment does not require any electronic control or diaphragm actuator, and consequently, the reliability can be enhanced, and production costs decreased.

Figure 28:
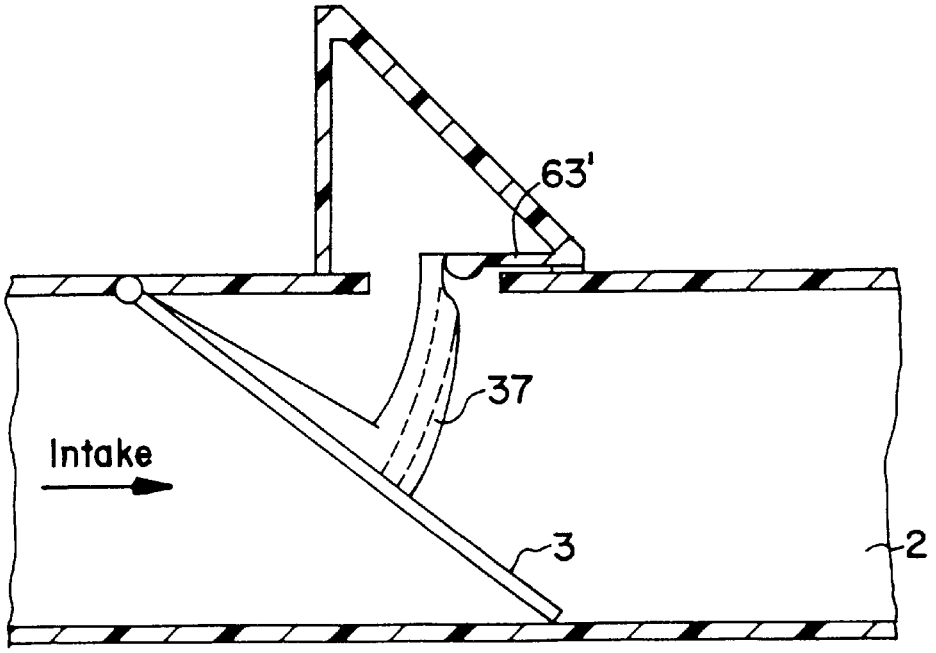
FIG. 28 is a longitudinal sectional view of a main part of a modification of the fourteenth embodiment of the present invention et the time a valve is in the fully closed position.
Figure 29:
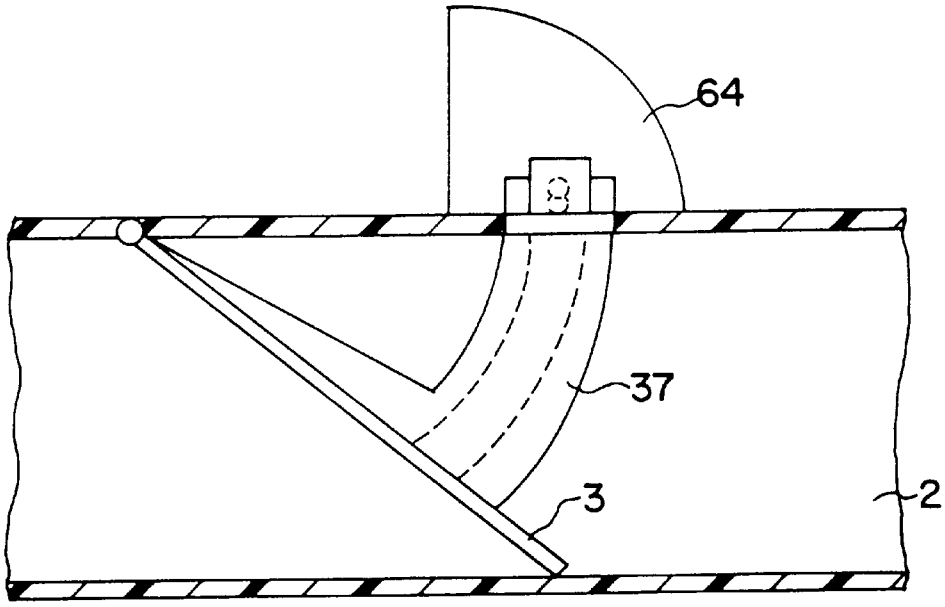
FIG. 29 is a longitudinal sectional view of a main part of another modification of the fourteenth embodiment of the present invention at the time a valve is in the fully closed position.
Figure 30:
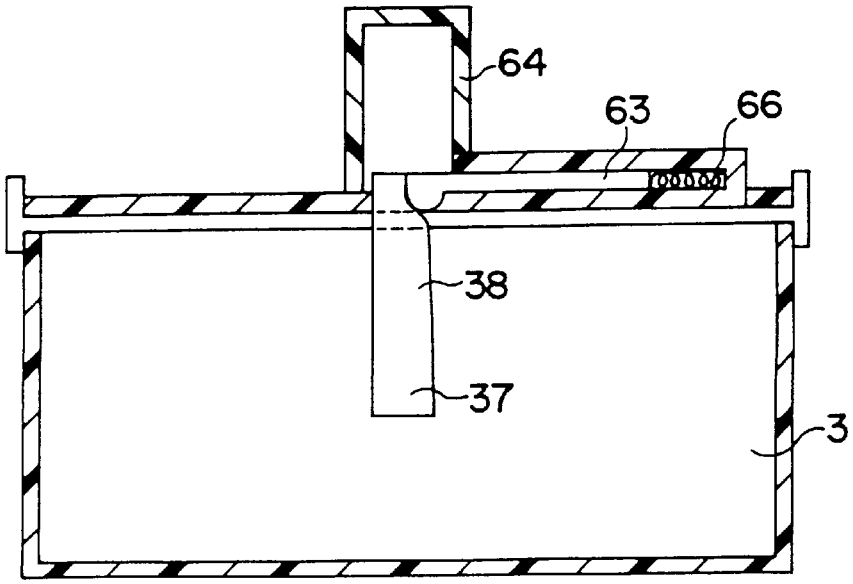
FIG. 30 is a cross-sectional view of the main part of the modification illustrated in FIG. 29 at the time the valve is in the fully closed position.
Figure 31:
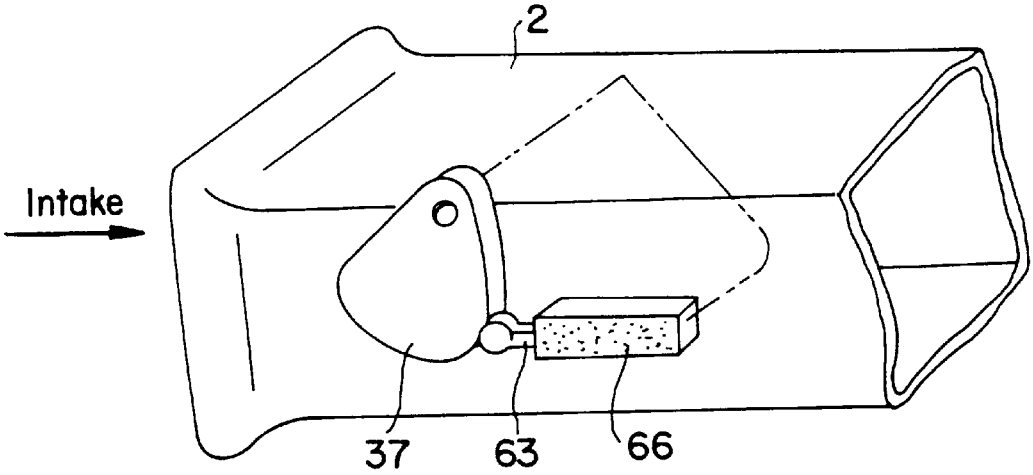
FIG. 31 is a perspective view of a main part of still another modification of the fourteenth embodiment of the present invention et the time a valve is in the fully closed position.

As illustrated in FIG. 28, instead of spring 66, a rod 63 which is elastically deformable upwardly and downwardly may be used. With this arrangement, similar operational advantages can be achieved. Furthermore, as illustrated in FIGS. 29 and 30, the moving direction of the rod 63 may be at right angles to that of the present embodiment. And, as illustrated in FIG. 31, the cam 37, rod 63 and a sponge 74, which replaces spring 66 may be provided outside the second intake passage 2.

(Embodiment 15)

Figure 32:
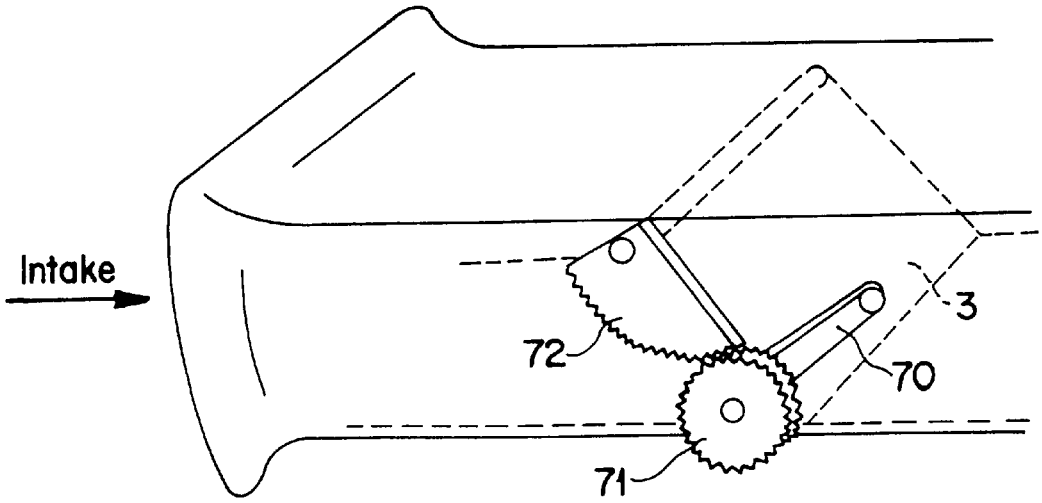
FIG. 32 is a perspective view of a main part of fifteenth embodiment of an intake duct in accordance with the present invention at the time a valve is in the fully closed position.

FIG. 32 illustrates the intake duct of their embodiment. As shown, the intake duct includes a valve 3 pivotally disposed in the second intake passage 2, and a swing arm 70 pivotally supported at one end on an outer surface of a side wall defining the second intake passage 2. A gear 71 is turnably supported at an opposite end of swing arm 70. An end of the pivot shaft of valve 3 projects from the second intake passage 2, and an elliptical gear 72, having a configuration of a quarter of a full-elliptical gear face, is secured thereto. Thus, the elliptical gear 72 turns with the pivotal movement of valve 3.

Swing arm 70 is biased upwardly by valve 3 (the direction of arrow A in FIG. 33) due to a spring (not shown), and the gear 71 is arranged so as to be pressed continuously on the elliptical gear 72 with the biasing force of the spring and to mesh therewith. A spring (not shown) is also retained by a shaft of the gear 71 such that the gear 71 is biased with the spring to turn in the direction of arrow B in FIG. 33. With the engagement of the elliptical gear 72 and gear 71, valve 3 is biased continuously with the spring (not shown) provided in the gear 71 in such a direction as to close the second intake passage 2.

The first intake passage 1 and air cleaner casing are constructed in a manner similar to that shown in Embodiment 11, but no return spring is provided in the valves.

The elliptical gear 72 is arranged such that when valve 3 closes the second intake passage 2, the major axis part thereof meshes with the gear 71, and as valve 3 opens the second intake passage 2, the minor axis part of the elliptical gear 72 gradually meshes with gear 71.

Figure 33:
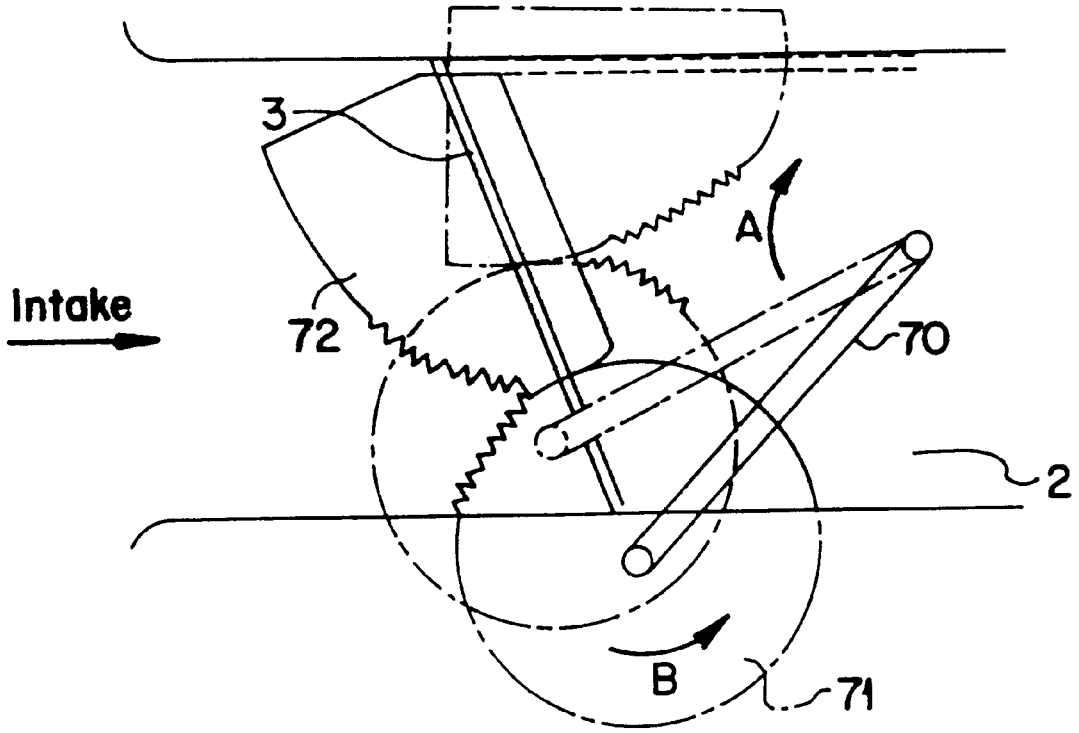
FIG. 33 is a diagram explaining the operation of the intake duct of the fifteenth embodiment of the present invention.

When valve 3 closes the second intake passage 2, as illustrated in FIG. 33, gear 71 meshes with the major axis part of elliptical gear 72 to bias valve 3 in such a direction as to close the second intake passage 2. This results in the rotational moment exerted on the elliptical gear 72 from the gear 71 to increase to continuously close the second intake passage 2 by valve 3 until the intake pressure in the second intake passage 2 reaches a predetermined value.

When the intake pressure increases and valve 3 pivots in such a direction as to open the second intake passage 2, the elliptical gear 71 turns while being restrained by the biasing force of the gear 72. Consequently, valve 3 pivots under the intake pressure to open the second intake passage 2. In this state, gear 71 meshes with the minor axis part of elliptical gear 72, so that the rotational moment exerted on the elliptical gear 72 from the gear 71 is small, and valve 3 opens the second intake passage 2 in accordance with the intake pressure. Thus, intake air is introduced mainly through the second intake passage 2, which has a larger diameter and a shorter length, preventing disadvantages such as a reduction in the amount of intake air. Furthermore, intake noise is mixed with engine noise so that it is not perceived as an unpleasant noise.

When the intake pressure becomes less than the rotational moment exerted on the elliptical gear 72 from the gear 71, the elliptical gear 72 pivots readily under the biasing force of gear 71, and valve 3 pivots readily to close the second intake passage 2.

With the intake duct of the present embodiment, valve 3 can be held in the fully-open state and fully-closed state automatically in accordance with the intake pressure, similarly to Embodiment 1. Consequently, both the reduction of intake noise and the assurance of a necessary amount of intake air can be effected without using a resonator or the like. In addition, the simple construction of the intake duct of the present embodiment does not require any electronic control or diaphragm actuator. Thus, reliability can be enhanced, and production costs decreased.

(Embodiment 16)

Figure 34:
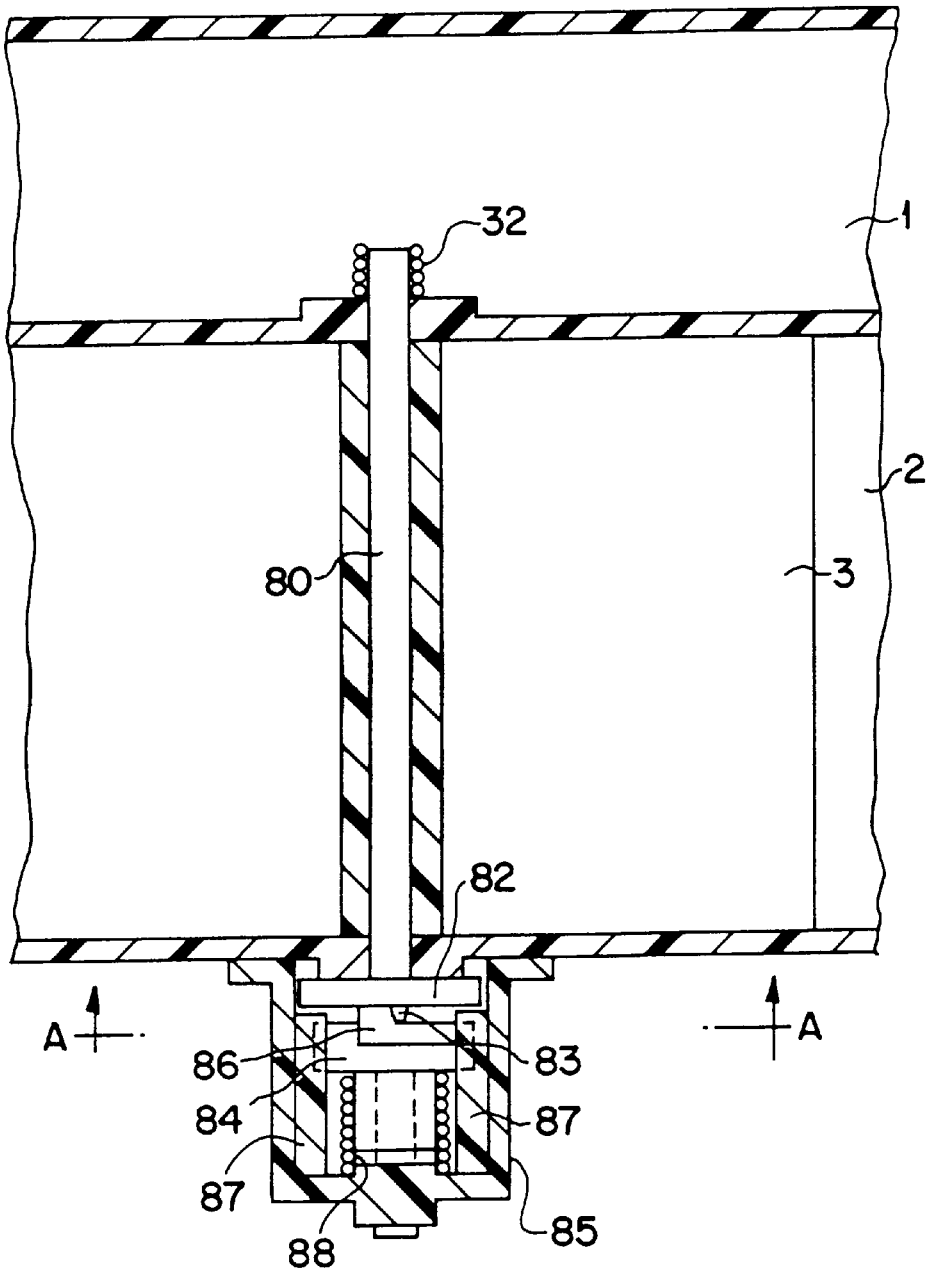
FIG. 34 is a longitudinal sectional view of a main part of a sixteenth embodiment of an intake duct in accordance with the present invention.
Figure 35:
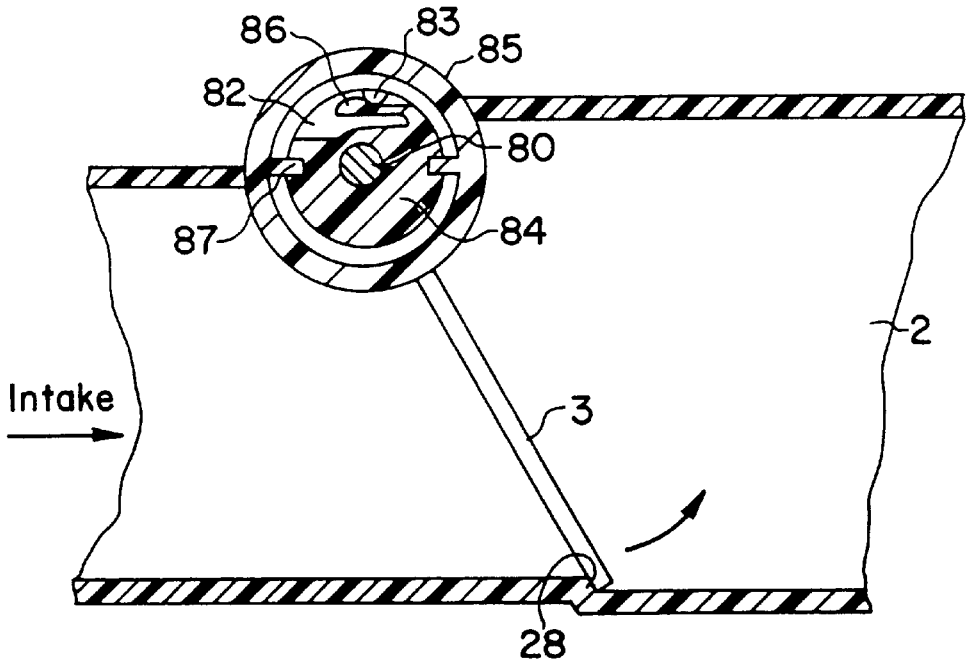
FIG. 35 is a longitudinal sectional view of the main part of the sixteenth embodiment of the intake duct at the time a valve is in the fully closed position, taken along the fine A—A of FIG. 34.
Figure 36:
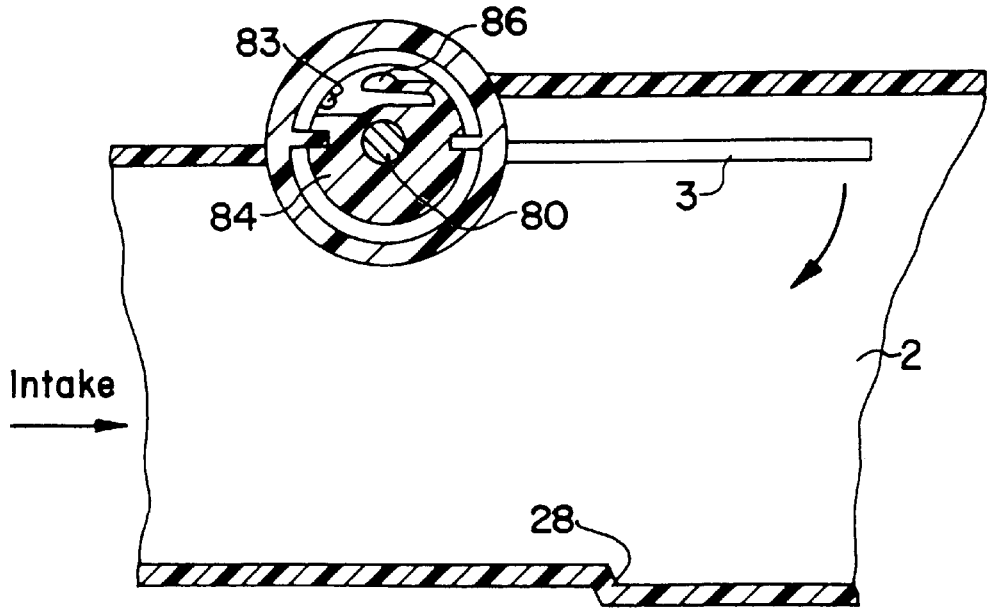
FIG. 36 is a longitudinal sectional view of the main part of the intake duct of the sixteenth embodiment at the time the valve is in the fully closed position, taken along the line A—A of FIG. 34.

FIGS. 34 through 36 show another arrangement for the intake duct of this embodiment. As shown, the intake duct includes a first intake passage 1 having a small diameter and a second intake passage 2 having a larger diameter joining the first intake passage 1. A junction of the first intake passage 1 and second intake passage 2 is not shown.

The sectional area of the first intake passage corresponds to that of a pipe of Ø40, and the sectional area of the second intake passage 2 corresponds to that of a pipe of Ø70. The distance between an open end of the first intake passage 1 and the junction of the first intake passage 1 and second intake passage 2 is longer than the distance between an open end of the second intake passage 2 and the above junction. A valve 3 is pivotally supported on a wall defining the second intake passages, and a step 28 is formed in the wall defining the second intake passage 2 which the pivotal end of the valve 3 is adapted to abut.

A return spring 32 is mounted on one end of a pivot shaft 80 of valve 3 to bias valve 3 to close the second intake passage 2. The other end of pivot shaft 80 projects from an outer surface of the wall defining the second intake passage 2, and a disk-like cam 82 is secured to that end of the pivot shaft 80 to turn with the turning of pivot shaft 80. Cam 82 is provided with a projection 83 which projects axially outwards.

A support member 84 is pivotally journaled on the other end of the pivot shaft 80 outside cam 82, and a cover 85 is further pivotally journaled outside the support member 84. The support member 84 has a claw 86 on the side facing cam 82. Claw 86 is elastically deformable, and one end of claw 86 is engageable with projection 83. The cover 85 is secured to an outer surface of a side wall defining the second intake passage 2 so that the turning of the cover 85 is limited. A pair of ribs 87 project radially inwardly. When ribs 87 are engaged with the support member 84, the turning of the support member 84 is limited. The support member 84 is guided with the ribs 87 so as to be movable in the axial direction of the pivot shaft 80. A spring 88 is interposed between the support member 84 and cover 85 to bias the support member 84 towards the cam 82.

With the intake duct of the present embodiment thus arranged, when the intake pressure in the second intake passage 2 is smaller than a predetermined value, as illustrated in FIG. 35, claw 86 and projection 83 are held in the engaging state under the biasing force of return spring 32 to limit the turning of cam 82, and the pivotal end of valve 3 is pressed on step 28 thereby closing the second intake passage 2. Thus, intake air is introduced only through the first intake passage 1 having a smaller diameter, and the acoustic mass increases reducing the low frequency intake noise without using a resonator or the like.

When the intake pressure increases and overcomes the biasing force of the return spring 32, valve 3 starts to pivot, the cam 82 begins to turn, and claw 86 deforms elastically and presses upon the projection 83. Thus, the elastic force of claw 86 acts as a reactive force until the intake pressure increases to some degree, so that the pivotal movement of valve 3 is limited via cam 82.

The rear face of the end of claw 86 has a configuration conforming to that of the projection 83. A gently curved face is formed from the rear face of claw 86 to the end thereof. When projection 83 gets over claw 86, the rear face of claw 86 is held engaged with projection 83 until the turning force of cam 82 exceeds a predetermined force.

When the intake pressure further increases and exceeds the predetermined value, projection 83 is disengaged from the rear face of claw 86 so that valve 3 pivots rapidly. This results in valve 3 pivoting further with the intake pressure. Also, when projection 83 abuts support member 84, as illustrated in FIG. 36, the turning of cam 82 is limited to bring valve 3 into a fully-open state which is generally parallel to the second intake passage 2. Thus, the second intake passages is opened. On the other hand, the claw 86 returns to its original state under the elastic reactive force thereof.

Thus, intake air is introduced mainly through the second intake passage 2 which has having a large diameter and short length to prevent the disadvantages such as the reduction in the amount of intake air. Also, since the intake noise is mixed with engine noise, it is not perceived as an unpleasant noise.

When the intake pressure decreases again, valve 3 pivots due to the biasing force of return spring 32, and consequently, projection 83 fits over the end of claw 86 again. At this time, the gently curved face of the end of claw 86 is pressed against the projection 83 so that claw 86 deforms elastically. After projection 83 fits over the end of claw 86, claw 86 returns to its original configuration under elastic reactive force. This results in projection 83 and rear face of claw 86 being engaged with each other to limit the turning of cam 82. Thus, valve 3 is pressed on step 28 and the pivotal movement thereof is limited to close the second intake passage 2. This results in valve 3 pivoting comparatively slowly in response to the elastic force of the claw 86 to abut the step 28, thereby closing the second intake passage 2 while moderating impact noise due to the abutment of valve 3 on step 28.

With the intake duct of the present embodiment, valve 3 can be held in its fully-open state and fully-closed state automatically in accordance with the intake pressure, and consequently, both the reduction of intake noise and the assurance of a necessary amount of intake air can be effected without using any resonator or the like. When projection 83 is disengaged from claw 86, valve 3 pivots rapidly to open the second intake passage 2 so that the disadvantages such as the generation of low frequency booming noise, which has been encountered with the conventional intake duct, can be prevented. In addition, the simple construction of the intake duct of the present embodiment does not require any electronic control or diaphragm actuator. Consequently, reliability can be enhanced, and production costs decreased.

(Embodiment 17)

Figure 37:
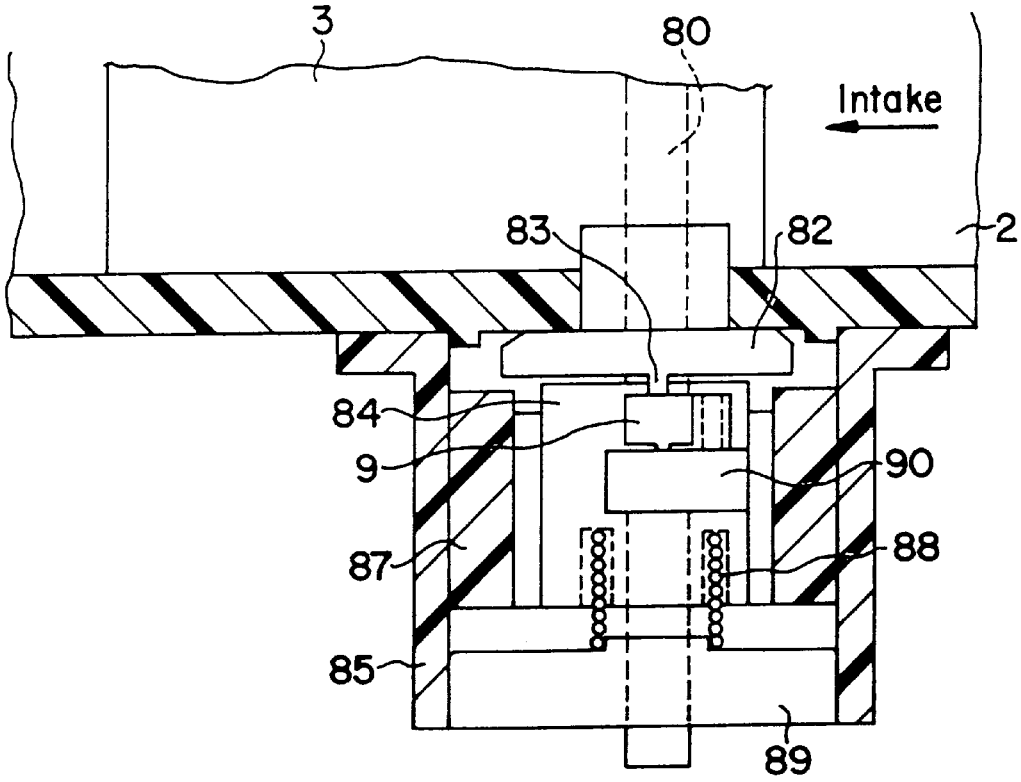
FIG. 37 is a longitudinal sectional view of a main part of a seventeenth embodiment of an intake duct in accordance with the present invention.
Figure 38:
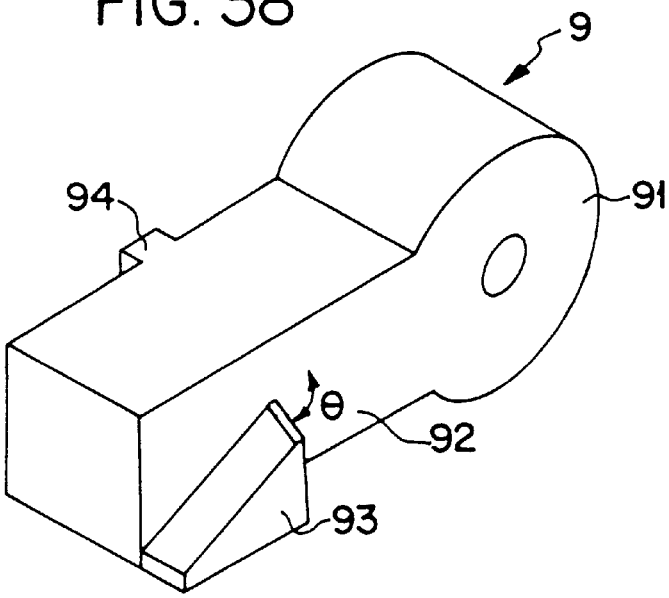
FIG. 38 is a perspective view of a lock member used in the intake duct of the seventeenth embodiment of the present invention.
Figure 39:
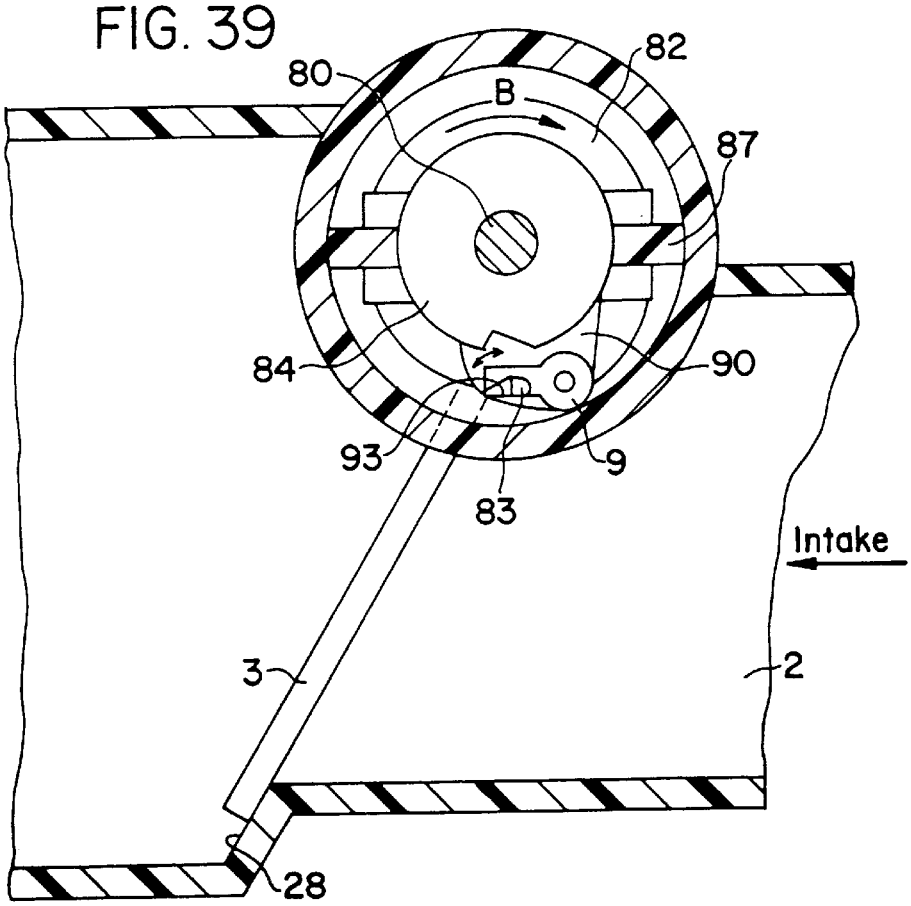
FIG. 39 is a longitudinal sectional view of a main part of the intake duct of the seventeenth embodiment of the present invention at the time a valve is in the fully closed position.
Figure 40:
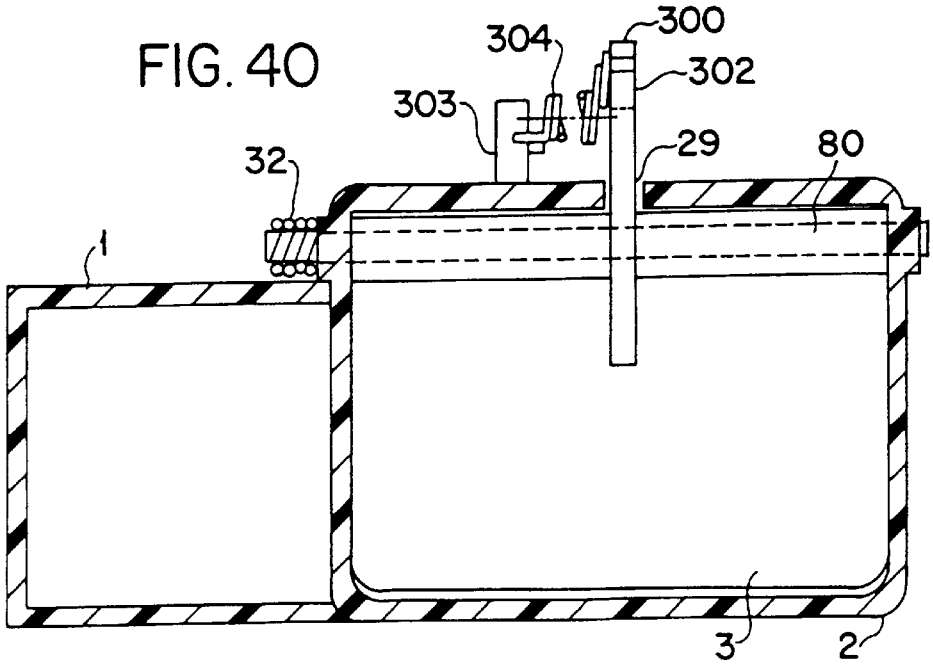
FIG. 40 is a view explaining the arrangement of an eighteenth embodiment of an intake duct in accordance with the present invention.
Figure 41:
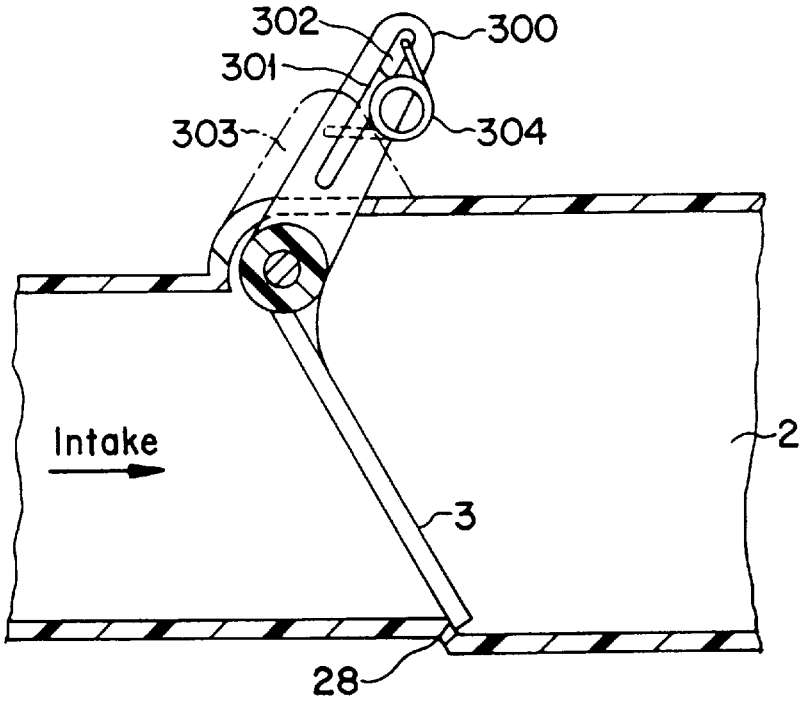
FIG. 41 is a longitudinal sectional view of a main part of the intake duct of the eighteenth embodiment of the present invention at the time a valve is in the fully closed position.

FIGS. 37 through 39 illustrate the intake duct of another embodiment. As shown, the intake duct has arrangement approximately identical to that of Embodiment 16 except that claw 86 has been replaced with a lock member 9.

A cam 82 has a projection 83, and is secured to one end of a pivot shaft 80 of a valve 3 to be turnable with the pivotal movement of the pivot shaft 80. A support member 84 is pivotally provided on the pivot shaft 80 outside cam 82, and a cover 85 to which a push member 89 is secured, is disposed outside support member 84. Cover 85 is secured to an outer surface of a wall defining a second intake passage 2 so that the turning of cover 85 is limited. The turning of the support member 84 is limited by the engagement of a pair of radially inwardly projecting ribs 87 with the support member 84. The support member 84 is guided with ribs 87 so as to be movable in the axial direction of the pivot shaft 80. A spring 88 is interposed between the support member 84 and push member 89 to bias the support member 84 towards cam 82.

The lock member 9 is pivotally provided on a support table 90 which projects from the periphery of the support member 84 such that the shaft thereof extends parallel to the pivot shaft 80. The lock member 9 can pivot on a plane at right angles to the axial direction of the pivot shaft 80.

As illustrated in FIG. 38, the lock member 9 has a main part 91 turnably supported on the support table 90, and an arm part 92 extending from the main part 91. The arm part 92 is provided with a convex part 93 having a tapered face. The angle ~ between the convex part 93 and arm part 92 is made slightly greater than a right angle. A projection 94 is formed in the arm part 92 on the opposite side of the convex part 93. One end of a spring (not shown) is attached to the projection 94. The other end of the spring is secured to the support member 84 such that when the end of the arm part 92 of the lock member 9 pivots close to the pivot shaft 80, the spring can bias the end of arm part 92 of lock member 9 away from the pivot shaft 80.

When the intake pressure in the second intake passage 2 is smaller than a predetermined value, as illustrated in FIG. 39, the convex part 93 of the lock member 9 and projection 83 are held engaged by the biasing force of a return spring 32 which is provided, similarly to Embodiment 16, to limit the turning of cam 82. The pivotal end of valve 3 is pressed on step 28 to close the second intake passage 2. Thus, intake air is introduced only through the first intake passage 1 having a smaller diameter, and consequently, the acoustic mass increases to reduce the low frequency intake noise without using any resonator or the like.

When the intake pressure increases and overcomes the biasing force of the return spring 32, valve 3 starts to pivot and cam 82 turns in the direction of arrow B in FIG. 39. This results in the lock member 9 being pivoted inwardly against the biasing force of the spring (not shown) while being pressed against the projection 83. Thus, until the intake pressure increases to some degree, the elastic force of the spring (not shown) acts as a reactive force so that the pivotal movement of the valves is limited via the lock member 9.

When the intake pressure increases further and exceeds the predetermined value, valve 3 pivots and the projection 83 fits over the convex part 93. This results in the lock created by lock member 9 being released, and valve 3 being drawn with the intake pressure to pivot rapidly, thus opening the second intake passage 2. On the other hand, the lock member 9 returns to its initial configuration with the elastic reactive force of the spring (not shown).

Thus, intake air is supplied mainly through the second intake passage 2 having a large diameter and short length to prevent the disadvantages such as the reduction in the amount of intake air. Also, since the intake noise is mixed with engine noise, it is not perceived as an unpleasant noise.

When the intake pressure decreases again, valve 3 pivots with the biasing force of the return spring 32, and consequently, projection 83 is guided by the tapered face of the convex part 93 so that the lock member 9 pivots outwardly, and projection 83 fits over the convex part 93 again. Then, the lock member 9 pivots to return to its original state. This results in the convex part 93 and projection 83 being engaged with each other to limit the turning of the cam 82.

Thus, valve 3 is pressed on step 28 and the pivotal movement thereof is limited to close the second intake passage 2. This results in the valve 3 pivoting at a comparatively slow speed under the elastic force of the spring (not shown) and the step 28, thus closing the second intake passage 2 while moderating impact noise due to the abutment of the valves on the step 28.

With the intake duct of the present embodiment, valve 3 can be automatically held in the fully-open state and fully-closed state in accordance with the intake pressure, similar to Embodiment 16. Consequently, both the reduction of intake noise and the assurance of a necessary amount of intake air can be effected without using a resonator or the like.

(Embodiment 18)

FIGS. 40 through 43 illustrate the intake duct of the still another. As shown, an arm 300 is provided at a longitudinal center of a pivot shaft 80 of a valve 3. The arm 300 projects from the pivot shaft 80 and extends outwardly from the second intake passage 2, after passing through a slit 29 formed therein. A slot 301 is formed in the arm 300, and a slider 302 is provided inside the slot 301 so as to be slidable therein. A projection 303 is provided in the outer wall defining the second intake passage 2 adjacent to the arm part 300. A torsional spring 304 is suspended between the slider 302 and the projection 303. The remaining arrangement of the present embodiment is nearly identical to that shown and described for Embodiment 16.

With the intake duct of the present embodiment thus arranged, arm 300 pivots on pivot shaft 80 with the pivotal movement of valve 3, and the torsion spring 304 moves therewith. When valve 3 pivots open (see FIGS. 40–42), the torsion spring 304 moves in the manner illustrated in FIG. 43.

Figure 42:
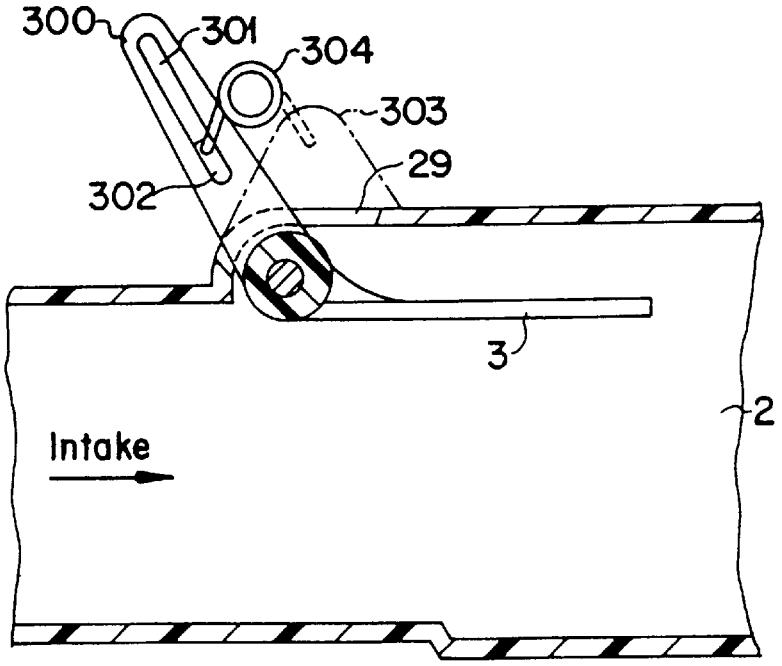
FIG. 42 is a longitudinal sectional view of the main part of the intake duct of the eighteenth embodiment of the present invention at the time the valve is in the closed position.
Figure 43:
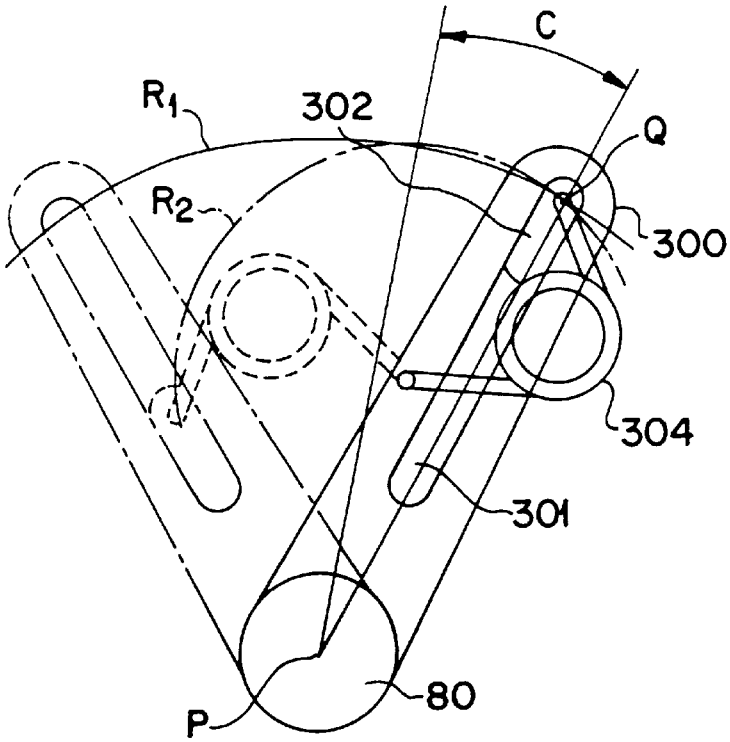
FIG. 43 is a diagram explaining the operation of the intake duct of the eighteenth embodiment of the present invention.

More specifically, when valve 3 pivots open (see FIGS. 40–42), one end of the torsion spring 304, which is retained by the slider 302, moves in the slot 301, as shown by a circular arc R2 in FIG. 43. On the other hand, when valve 3 is closed (FIG. 41), a point Q of the one end of the torsion spring 304, which is retained by the slider 302, moves along a circular arc $R_1$ of which the center exists in the center (P) of the pivot shaft 80. This results in the distance between one end of the torsion spring 304 and the other end thereof, which is retained by the projection 303, to decrease only in the range C. In this range C, the torsion spring 304 generates a biasing force.

When the intake pressure in the second intake passage 2 is smaller than a predetermined value, valve 3 is pressed on the step 28 with the biasing force of the return spring 32, similar to Embodiment 16, holding the second intake passage 2 closed.

When the intake pressure increases and valve 3 is about to open the second intake passage 2, the valve 3 is held closed until the intake pressure exceeds the combined force of the biasing force of the return spring 32 and that of the torsion spring 304. This occurs because the biasing force of torsion spring 304 is applied when arm 301 is in the range C (FIG. 43).

When the intake pressure exceeds the combined force of the biasing force of return spring 32 and that of the torsion spring 304, valve 3 pivots so that arm 300 moves out of the range C. This results in the biasing force of the torsion spring 304 not being applied, and valve 3 pivots rapidly with the intake pressure to open the second intake passage 2, as illustrated in FIG. 42.

Thus, intake air is supplied mainly through the second intake passage 2 having a large diameter and short length to prevent the disadvantages such as the reduction in the amount of intake air. Also, the intake noise is mixed with engine noise so that it is not perceived as an unpleasant noise.

When the intake pressure decreases again, valve 3 pivots under the biasing force of return spring 32, and the biasing force of the torsion spring 304 is applied when arm part 300 is in the range C. This results in the valve pivoting at a comparatively slow speed in the range C to abut the step 28, closing the second intake passage 2 while moderating impact noise due to the abutment of the valves on the step 28.

With the intake duct of the present embodiment, valve 3 can be automatically held in its fully-open state and fully-closed state in accordance with the intake pressure, similar to Embodiment 16. Consequently, both the reduction of intake noise and the assurance of a necessary amount of intake air can be effected without using any resonator or the like.

(Embodiment 19)

However, the intake duct of Embodiment 18 wherein arm 300 projects from the second intake passage 2 requires slit 29 in the wall defining the second intake passage 2, which may leak intake noise.

Figure 44:
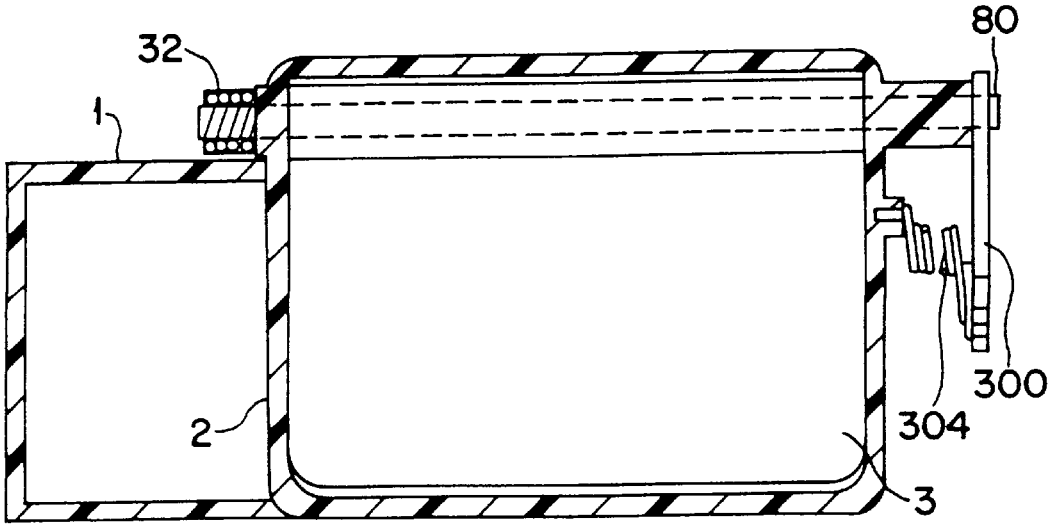
FIG. 44 is a view explaining the arrangement of a nineteenth embodiment of an intake duct in accordance with the present invention.

To overcome this problem as illustrated in FIG. 44, an arm 300 is secured to one end of a pivot shaft 80 outside of a wall defining the second intake passage 2 while a torsion spring 304 is suspended between a slider 302 and the side wall defining the second intake passage 2.

With the intake duct of the present embodiment, operational advantages similar to those of Embodiment 18 are achieved, it becomes unnecessary to form a slit such as the slit 29 so that the leaking of intake noise can be prevented with certainty.

(Embodiment 20)

Figure 45:
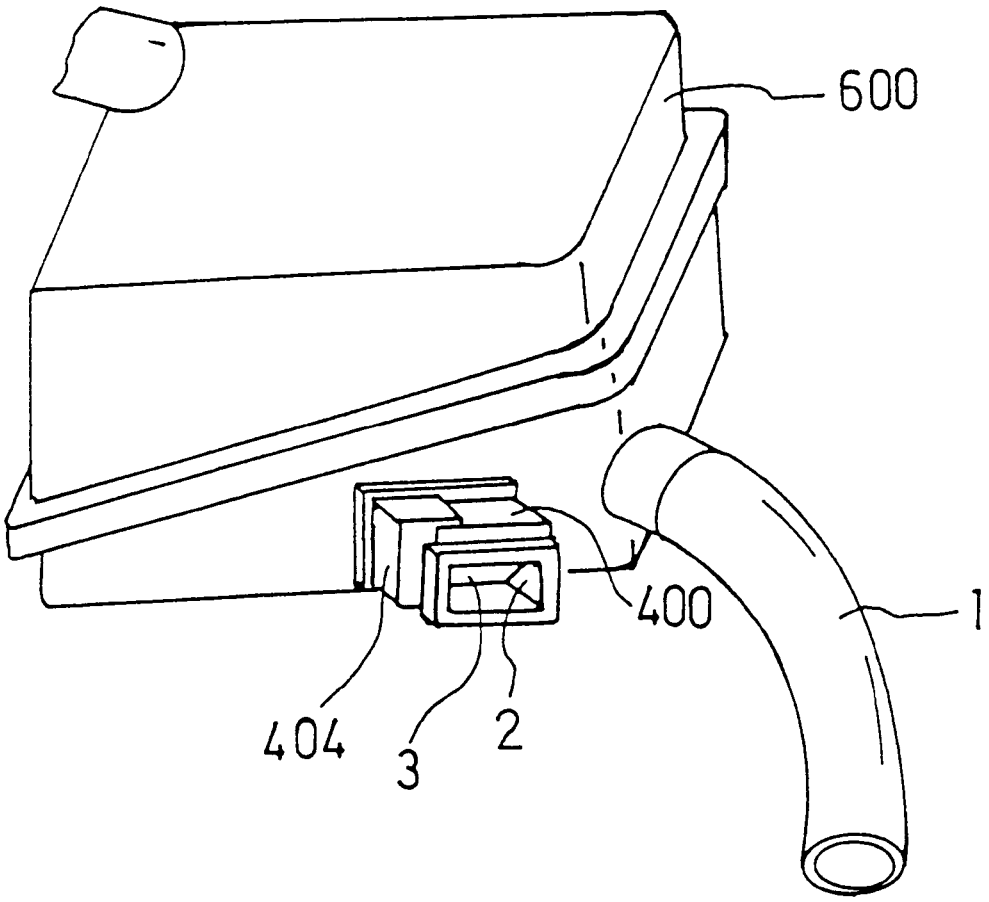
FIG. 45 is a perspective view illustrating the arrangement of a twentieth embodiment of an intake duct in accordance with the present invention.

FIG. 45 illustrates an intake duct of one embodiment of the present invention. As shown, a first intake passage 1 having a small diameter and a second intake passage 2 having a diameter greater than that of the first intake passage 1 are interconnected with an air cleaner casing 600, respectively.

The cross-sectional area of the first intake passage 1 is equal to that of a pipe of Ø40 while the cross-sectional area of the second intake passage 2 is equal to that of a pipe of Ø70. A control part 400 is provided in the vicinity of an inlet port of the second intake passage 2.

Figure 46:
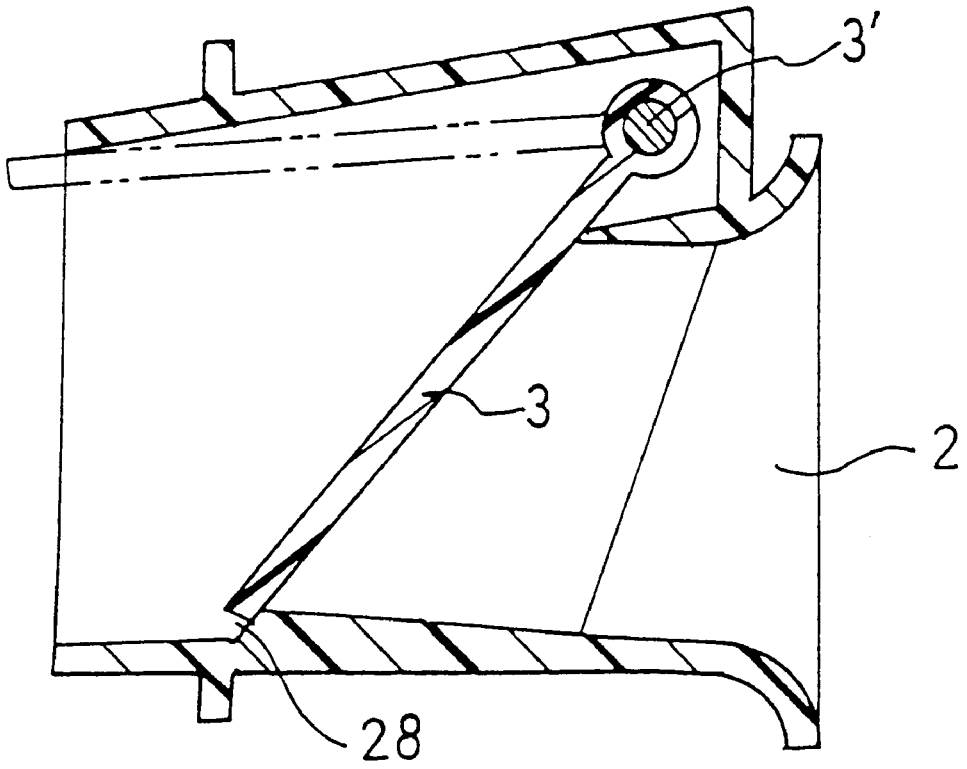
FIG. 46 is a longitudinal sectional view of a main part of a twentieth embodiment of an intake duct in accordance with the present invention at the time a valve is in the fully closed position.

As illustrated in FIG. 46, in the control part 400, a valves is pivotally secured to a pivot shaft 3'. In an inner surface of a wall defining the second intake passage 2, a step 28 is provided. A pivotal end of the valves is adapted to abut the step 28.

Figure 47:
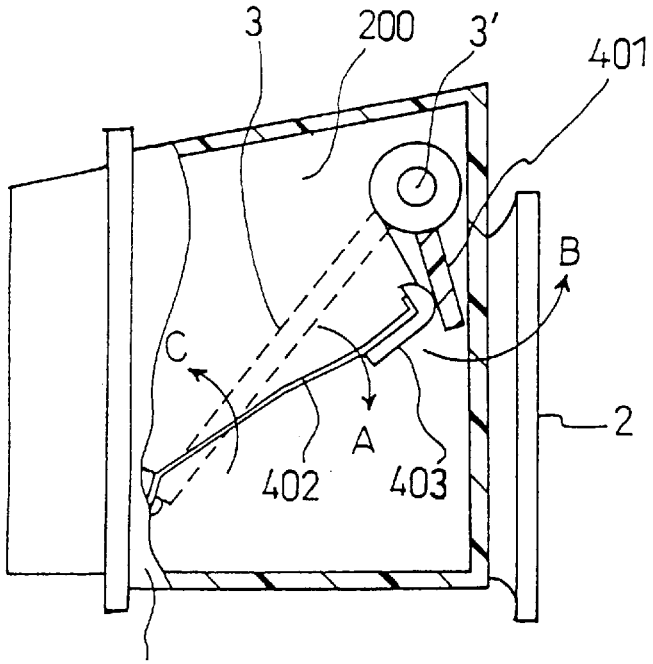
FIG. 47 is a partially cut away side view of a main part of a twentieth embodiment of an intake duct in accordance with the present invention at the time a valve is in the fully closed position.
Figure 48:
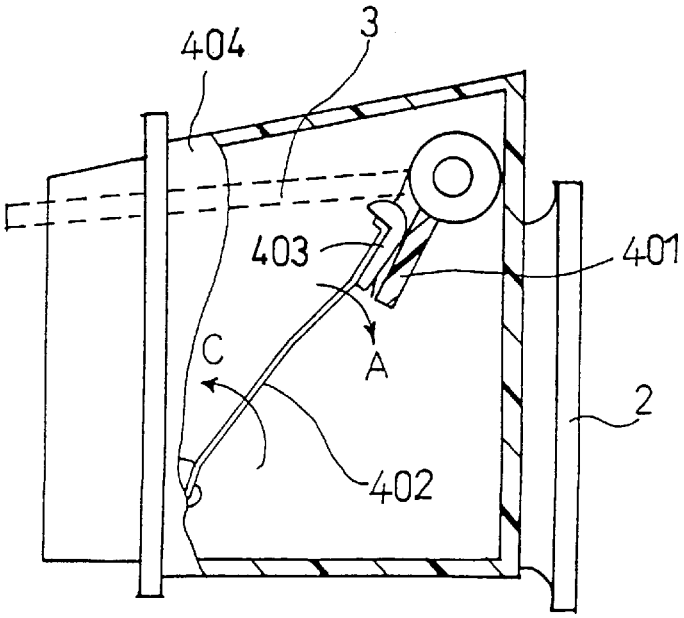
FIG. 48 is a partially cut away side view of a main part of a twentieth embodiment of an intake duct in accordance with the present invention et the time a valve is in the fully closed position.
Figure 49:
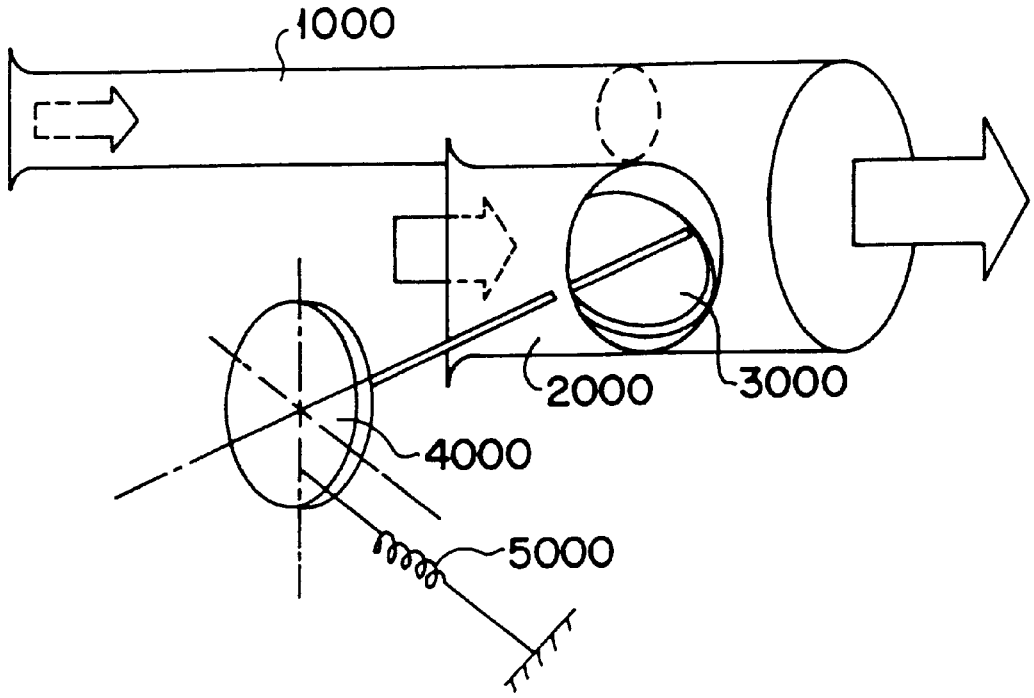
FIG. 49 (RELATED ART)
FIG. 49 is a diagram explaining the arrangement of a conventional intake duct.

As illustrated in FIGS. 47 and 48, an arm 401 projects from an outer surface 200 of the wall defining the second intake passage 2. One end of the arm 401 is integrally connected to the pivot shaft 3' of the valve 3 so as to pivot with the valve 3. A leaf spring 402 composed of a spring steel is also provided in the outer surface 200. One end of the leaf spring 402 is secured to the outer surface 200 while a distal end of the leaf spring 402 abuts the arm 401. A rotational moment A is applied to the distal end of the leaf spring 402 with a spring force thereof in the direction of arrow A in FIG. 47 so that the leaf spring 402 biases the arm 401 in the direction of arrow B in FIG. 47. A slide part 403 composed of POM (polyacetals) is secured to the distal end of the leaf spring 402. The arm 401 and leaf spring 402 thus arranged are covered with a cover 404 composed of resin. In FIGS. 47 and 48, the cover 404 is partly cut away for purposes of explanation.

With the intake duct thus arranged, in the case the intake pressure in the second intake passage 2 is less than a predetermined value, the valve 3 is pressed down with the biasing force of the leaf spring 402, and, as shown in FIG. 47, the second intake passage 2 is closed with the valve 3 while the slide part 403 of the leaf spring 402 abuts the vicinity of the pivotal end of the arm 401.

As the intake pressure increases, a force is applied to the contacting point between the leaf spring 402 and arm 401 in the direction of the securing end of the leaf spring 402, which results in the rotational moment C in the direction of arrow C in FIG. 47 being applied to the leaf spring 402 due to the component of the above force. On the other hand, the rotational moment A in the direction of arrow A in FIG. 47 is applied to the distal end of the leaf spring 402 due to the spring force thereof. While the rotational moment A applied to the above contacting point is greater than the rotational moment C, the arm 401 is pressed with the leaf spring 402 in the direction of arrow B, thus restraining the pivotal movement of the valve 3 to hold the second intake passage 2 in the closed state. In this case, intake air is introduced merely via the first intake passage 1 having a smaller diameter so that the acoustic mass increases to reduce the intake noise of low frequencies without using any resonator or the like. The pivotal end of the valve 3 is in the pressed state on the step 28 so that the flattering thereof is prevented.

Thus, until the intake pressure increases to a certain level, the pivotal movement of the valve 3 is restrained with the biasing force of the leaf spring 402, which is applied to the arm 401. Consequently, at a low engine speed, intake noise can be effectively prevented end the flattering of the valves can tee also restrained.

When the intake pressure increases and the rotational moment C becomes greater than the rotational moment A, the leaf spring 402 deforms while sliding on the surface of the arm 401, and the valve 3 pivots to open the second intake passages, as illustrated in FIG. 48. In this case, while the rotational moment C is greater than the rotational moment A, the valve 3 is held in the opening state of the second intake passage 2.

Consequently, intake air is introduced mainly via the second intake passage 2 having a large diameter and small length to overcome disadvantages such as the reduction in the amount of intake air. Resultant intake noise is mixed with engine noise so as not to be perceived as an unpleasantness.

When the intake pressure decreases again, and the rotational moment A becomes greater than the rotational moment C, the arm 401 is pressed down with the leaf spring 402 so that the valve 3 readily pivots to close the second intake passage 2, as illustrated in FIG. 47.

With the intake duct in accordance with the present embodiment, the valve 3 can be held in the fully open state and fully closed state automatically in accordance with the intake pressure. Consequently, the reduction of the intake noise and insurance of a required amount of intake air can be effected without using any resonator or the like. Furthermore, the intake duct of the present embodiment has a simple construction which does not require any electric control system or diaphragm actuator. Consequently, the reliability thereof is enhanced and production costs are low.

Since the leaf spring 402 is in sliding contact with the arm 401 via the slide part 403, it can move smoothly with a reduced friction resistance. And since both the arm 401 and leaf spring 402 are provided outside the second intake passage 2, and covered with the cover 404, water and dust are prevented from attaching to sliding faces there between, and consequently, the decrease in operational accuracy is prevented.

While the invention has been described in connection with what are considered presently to be the most practical and preferred embodiments, it is to be understood that the invention is not limited to the described embodiments, but, on the contrary, is intended to cover various modifications and equivalent arrangements included within the spirit and scope of the claims.

What is claimed is:

1. An intake duct as a passageway adapted to supply air to an engine, comprising:

a first intake passage;

a second intake passage;

a valve member pivotally provided in said second intake passage to open and close said second intake passage;

biasing means for biasing said valve member in such a direction as to close said second intake passage; and valve adjusting means for restraining the movement of said valve member when said valve member brings said second intake passage from the closed state to the open state, and facilitating the movement of said valve member when said valve member brings said second intake passage from the open state to the closed state.

2. An intake duct as claimed in claim 1, wherein said valve adjusting means includes a cam interposed between said valve member and sai biasing means, and having a point of pivotal center, to which a pivot shaft of said valve member is secured, and a point of action, which is provided away from said point of pivotal center and to which is a biasing force of said biasing means is applied such that when intake pressure in said second intake passage is a predetermined value or less, the rotational moment due to the biasing force of said biasing means becomes greater than that due to the intake pressure at said point of action to close said second intake passage, and when intake pressure in said second intake passage exceeds said predetermined value, the rotational moment due to the intake pressure becomes greater than that due to the biasing force of said biasing means at said point of action to open said second intake passage.

3. An intake duct as claimed in claim 1, wherein said valve adjusting means includes hold means for holding said valve member in the closing state of said second intake passage, and control means for change overing the holding of said valve member by said hold means and releasing of said valve member therefrom such that when intake pressure in said second intake passage is a predetermined value or less, said control means controls said hold means to hold said valve member in the closing state of said second intake passage, and when intake pressure of said second intake passage exceeds said predetermined value, said control means controls said hold means to release the holding of said valve member, whereby said valve member opens said second intake passage with said intake pressure.

4. An intake duct as claimed in claim 1, wherein said second intake duct has a guide face which guides a pivotal end face of said valve member close thereto when said valve member opens said second intake passage.

5. An intake duct as claimed in claim 2, wherein said second intake duct has a guide face which guides a pivotal end face of said valve member close thereto when said valve member opens said second intake passage.

6. An intake duct as claimed in claim 3, wherein said second intake duct has a guide face which guides a pivotal end face of said valve member close thereto when said valve member opens said second intake passage.

7. An intake duct as claimed in claim 1, wherein said second intake passage has an engaging face which said valve member abuts when said valve member closes said second intake passage, and further comprising resisting means which applies a resistance force to said valve member when said valve member separates from said engaging face.

8. An intake duct as claimed in claim 2, wherein said second intake passage has an engaging face which said valve member abuts when said valve member closes said second intake passage, and further comprising resisting means which applies a resistance force to said valve member when said valve member separates from said engaging face.

9. An intake duct as claimed in claim 3, wherein said second intake passage has an engaging face which said valve member abuts when said valve member closes said second intake passage, and further comprising resisting means which applies a resistance force to said valve member when said valve member separates from said engaging face.

10. An intake duct as a passageway adapted to supply air to an engine, comprising:

a first intake passage;

a second intake passage;

a valve member pivotally provided in said second intake passage to open end close said second intake passage;

an interlocking member provided outside one of said first intake passage and said second intake passage for pivoting while interlocking with the pivotal movement of said valve member;

a stay pivotably provided outside one of said first intake passage and said second intake passage, said stay having a pivotal end adapted to abut and slide on a surface of said interlocking member in accordance with the pivotal movement of said interlocking member; and biasing means for biasing said stay such that said valve member pivots in such a direction as to close said second intake passage, said valve member opening said second intake passage when a rotational moment applied to said stay upon pivoting of said interlocking member due to the intake pressure in said second intake passage is greater than a rotational moment generated in said stay with said biasing means, and said valve member closing said second intake passage when said rotational moment applied to said stay upon pivoting of said interlocking member due to the intake pressure in said second intake passage is less than said rotational moment generated in said stay with said biasing means.

11. An intake duct as claimed in claim 3, wherein said stay comprises a leaf spring and functions as said biasing means.

12. An intake duct as claimed in claim 3, further comprising a cover which covers said interlocking member and said stay.

13. An intake duct as claimed in claim 3, further comprising a sliding portion having small frictional resistance at a distal end of said stay and on a surface having abutted and slided to said stay of said interlocking member.

* * * * *